US007441853B2

(12) United States Patent
Takata

(10) Patent No.: US 7,441,853 B2
(45) Date of Patent: Oct. 28, 2008

(54) IMAGE FORMING APPARATUS AND DRIVE CONTROL METHOD FOR LIQUID EJECTION HEAD

(75) Inventor: Takuya Takata, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 443 days.

(21) Appl. No.: 11/210,968

(22) Filed: Aug. 25, 2005

(65) Prior Publication Data

US 2006/0044337 A1 Mar. 2, 2006

(30) Foreign Application Priority Data

Aug. 27, 2004 (JP) ..... 2004-248651

(51) Int. Cl.
*B41J 29/38* (2006.01)

(52) U.S. Cl. ..... 347/14; 347/10; 347/57

(58) Field of Classification Search ..... 347/9–15, 347/57

See application file for complete search history.

(56) References Cited

U.S. PATENT DOCUMENTS

| | | | | |
|---|---|---|---|---|
| 6,280,799 | B1 * | 8/2001 | Okabe et al. | 427/466 |
| 6,357,846 | B1 | 3/2002 | Kitahara | |
| 6,457,807 | B1 * | 10/2002 | Hawkins et al. | 347/40 |
| 6,619,777 | B2 | 9/2003 | Chang | |
| 6,830,303 | B2 | 12/2004 | Tamura | |
| 6,874,862 | B2 * | 4/2005 | Shade | 347/40 |
| 2002/0033852 | A1 | 3/2002 | Chang | |
| 2003/0227497 | A1 | 12/2003 | Tamura | |

FOREIGN PATENT DOCUMENTS

| | | | |
|---|---|---|---|
| JP | 2-1310 | A | 1/1990 |
| JP | 6-127034 | A | 5/1994 |
| JP | 2000-37867 | A | 2/2000 |
| JP | 3072740 | B2 | 6/2000 |
| JP | 2001-293856 | A | 10/2001 |
| JP | 2002-103617 | A | 4/2002 |
| JP | 2002-154207 | A | 5/2002 |
| JP | 2002-283556 | A | 10/2002 |
| JP | 2003-291342 | A | 10/2003 |

* cited by examiner

*Primary Examiner*—Thinh H Nguyen
(74) *Attorney, Agent, or Firm*—Birch, Stewart, Kolasch & Birch, LLP

(57) ABSTRACT

The image forming apparatus comprises: a liquid ejection head which includes a plurality of nozzles and a plurality of pressure generating elements provided correspondingly to the plurality of nozzles, the pressure generating elements being applied with drive signals to eject recording liquid from the corresponding nozzles; a plurality of driving wave generating circuits which generate drive-signal waves for driving the pressure generating elements; a circuit selecting device which selectively switches the driving wave generating circuits to apply the drive-signal waves to the pressure generating elements; a power source which supplies electricity to the pressure generating elements through the driving wave generating circuits; a connection control device which, in accordance with image data representing an image to be formed, selects at least one of the driving wave generating circuits used to drive the pressure generating elements, and controls connection between the at least one of the driving wave generating circuits and the pressure generating elements, so that instantaneous current consumption of each of the driving wave generating circuits falls within a specific allowable value; and a phase control device which controls phases of the drive-signal waves generated by the driving wave generating circuits so that the instantaneous current consumption at the power source falls within a specific upper limit.

19 Claims, 18 Drawing Sheets

VOLTAGE
T0
T0
COM1-1
COM1-2
TIME

VOLTAGE
COM2-1
COM2-2
TIME

VOLTAGE
COM3-1
COM3-2
TIME

VOLTAGE
COM4-1
COM4-2
TIME

VOLTAGE
TIME

POSITION CONTROL

DEPOSITION NUMBER OF TIMES CONTROL

NORMAL LARGE DOTS

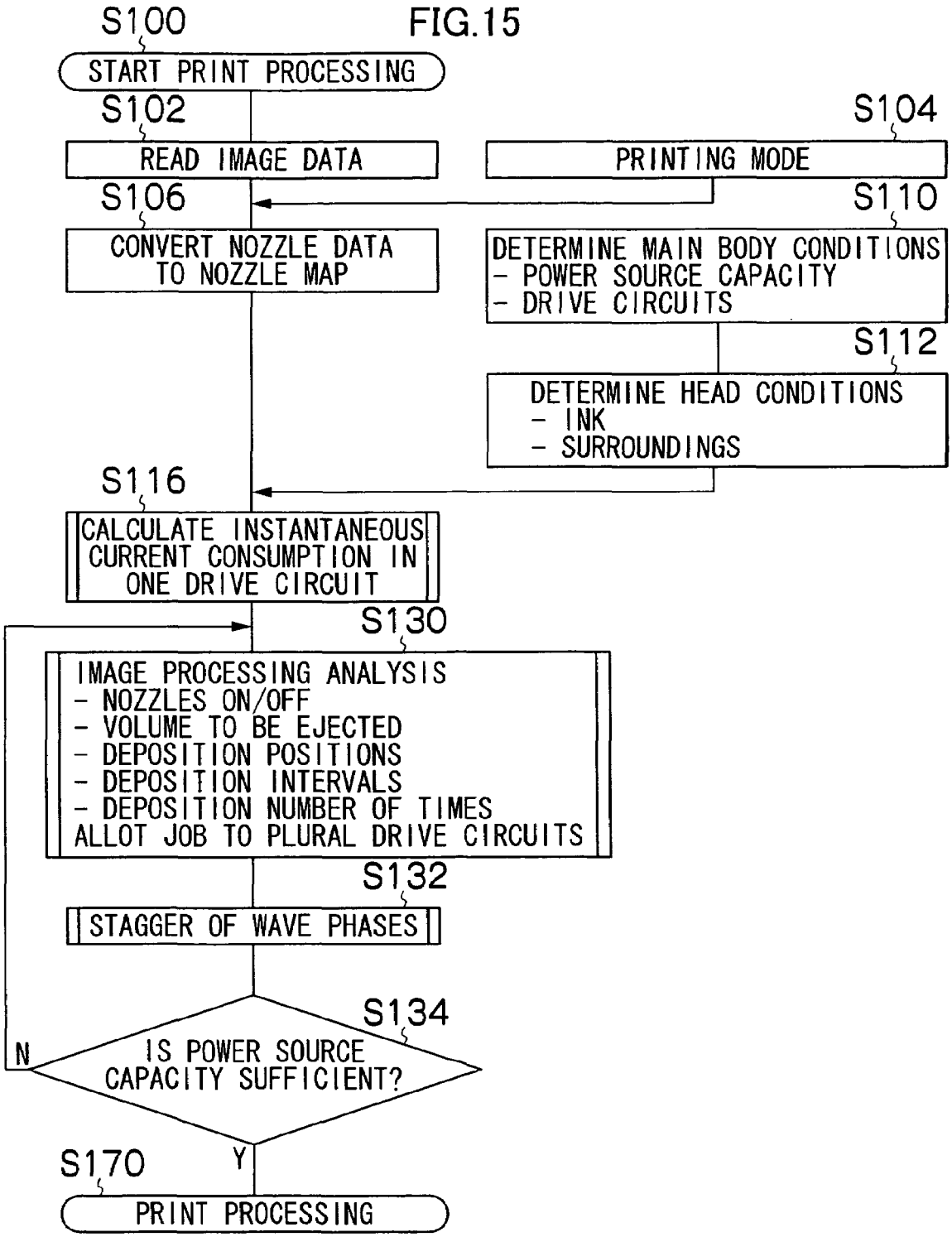
FIG.15
S100
START PRINT PROCESSING
S102
READ IMAGE DATA
S104
PRINTING MODE
S106
CONVERT NOZZLE DATA TO NOZZLE MAP
S110
DETERMINE MAIN BODY CONDITIONS
- POWER SOURCE CAPACITY
- DRIVE CIRCUITS
S112
DETERMINE HEAD CONDITIONS
- INK
- SURROUNDINGS
S116
CALCULATE INSTANTANEOUS CURRENT CONSUMPTION IN ONE DRIVE CIRCUIT
S130
IMAGE PROCESSING ANALYSIS
- NOZZLES ON/OFF
- VOLUME TO BE EJECTED
- DEPOSITION POSITIONS
- DEPOSITION INTERVALS
- DEPOSITION NUMBER OF TIMES
ALLOT JOB TO PLURAL DRIVE CIRCUITS
S132
STAGGER OF WAVE PHASES
S134
IS POWER SOURCE CAPACITY SUFFICIENT?
N
Y
S170
PRINT PROCESSING

IMAGE FORMING APPARATUS AND DRIVE CONTROL METHOD FOR LIQUID EJECTION HEAD

BACKGROUND OF THE INVENTION

1. Field of the Invention

The present invention relates to an image forming apparatus and a drive control method for a liquid ejection head, and particularly relates to an image forming apparatus that forms images using a liquid ejection head having pressure generating elements corresponding to multiple ejection ports (nozzles), and to a drive control technique for a liquid ejection head suitable for this apparatus.

2. Description of the Related Art

Generally, in inkjet recording apparatuses (inkjet printers), printing is performed by ejecting ink droplets from the nozzles of a recording head at specific timings on the basis of dot pattern data (also referred to as "dot data" or "print data") resulting from the development of image data for printing inputted from a host computer, and depositing and sticking these ink droplets onto recording paper or another such print recording medium.

A known example of a recording head system is a system that ejects ink droplets by varying the volume of a pressure chamber (pressure creating chamber) communicated with the nozzle opening. In this type of recording head, a diaphragm capable of elastic deformation in the out-of-plane direction is formed on part of the peripheral wall formed to partition the pressure chamber, and the volume of the pressure chamber is varied by vibrating the diaphragm with a pressure generating element, typified by a piezoelectric element.

Normally, a plurality of nozzle openings are formed in the recording head, and a pressure chamber and a piezoelectric element are provided for each nozzle opening. All of the piezoelectric elements are electrically connected in parallel between a common electric supply line and a ground line, and switching elements are electrically connected in series for the respective piezoelectric elements. Signals (driving waves) for driving the piezoelectric elements are generated by a driving wave generating circuit, and are selectively distributed and supplied to the piezoelectric elements via the electric supply line and the switching elements.

More specifically, when a specific switching element is selected and turned on according to the print data, a driving wave is applied to the piezoelectric element via the electric supply line, and an ink droplet is ejected from the specific nozzle opening corresponding to the piezoelectric element to which the driving wave is applied.

Inkjet recording apparatuses that use piezoelectric elements as described above usually have a common drive circuit system, in which one common driving wave resulting from a combination of a plurality of driving wave elements for ejecting a plurality of types of ink droplets with different ink volumes (for example, for a large dot, medium dot, and small dot) is provided, and one of the wave components necessary for each piezoelectric element is selectively applied by switching (see Japanese Patent Application Publication Nos. 2002-154207 and 2000-37867). This system has advantages in that there is no need to separately prepare a plurality of driving wave generating circuits for the respective piezoelectric elements, and that the number of high voltage and high precision analog circuits and the number of wires can be reduced, since the common driving wave is simultaneously applied to the plurality of piezoelectric elements.

Also, printers with an array system or a line system have recently been proposed with the object of increasing the printing speed, in which an extremely large number of nozzles are arranged and ink is simultaneously ejected from multiple nozzles to perform high-speed print recording. Array system or line system recording heads with multiple nozzles have problems in that if the common drive circuit system described above is applied as is, multiple piezoelectric elements are simultaneously driven by a driving wave output from the single drive circuit, which causes driving wave distortion due to heavy load fluctuations and causes unsatisfactory ejections, and results in image unevenness. Moreover, since the multiple piezoelectric elements are simultaneously driven, there is the possibility that a large electric current will instantaneously flow through the transistor that constitutes a power amplifier in the drive circuit, the electric current will exceed the driving capabilities of the transistor (Icmax: the maximum collector current), and the generated heat will exceed the allowable power dissipation of the transistor (Pcmax: the maximum collector power dissipation).

Increasing the size of the transistor used in the power amplifier and increasing the size of the radiator have been considered as solutions for this problem. However, the response of large transistors is slow and not enough for a driving wave with a shorter ejection cycle, which generally has a faster wave switching time, then the optimum power amplifier does not exist, and the radiator must be extremely large as a result.

Therefore, in conventional practice, configurations have been proposed in which the nozzles are driven by a plurality of drive circuits. For example, Japanese Patent Application Publication No. 6-127034 discloses a circuit dividing system in which the nozzles in the recording head are divided into groups, and the nozzles are driven using separate drive circuits for the respective groups. Dividing the load with a plurality of drive circuits in this manner makes it possible to reduce the load for each drive circuit, to reduce the drive current and the heat generated, and to use compact transistors whose speed can be increased. However, with such a conventional configuration, there is a possibility that the load will concentrate in only some of the drive circuits depending on the printing conditions, so that the drive circuits must be set with the assumption that such load concentration will occur. Therefore, there is a tendency for the capacity of the drive circuits to be excessive and for the number of drive circuits installed to be excessive in comparison with the load that actually occurs.

With normal printing, it is rare for all the piezoelectric elements to be simultaneously driven, and the number of piezoelectric elements driven simultaneously is usually half or less of the total number of the elements. This tendency is particularly apparent when inks of some colors are used in a color printer. For example, with a six-color ink printer, the number of piezoelectric elements driven simultaneously is about ⅓ the total number of the piezoelectric elements on average.

However, in a conventional circuit dividing system, the load concentrates in only part of the drive circuits during printing in which the load on a nozzle group is severely increased, such as printing in which only one of the ink colors is used. The waveform distortion and the ink ejection conditions are different in drive circuits in which the load excessively concentrates and in drive circuits there is no concentration. This results in the possibility that image unevenness will occur.

Tests have been conducted as means for resolving these problems, wherein load nonuniformities between circuits are suppressed and waveform distortion in circuit units is reduced by driving, separately from the actual load, a dummy element such as a ceramic condenser instead of a nonoperating piezoelectric element. However, this conventional method of using a dummy element consumes an unnecessary amount of electricity because all the driving wave generating units are operated even when only a small number of nozzles are used.

Therefore, other methods have been considered for arbitrarily switching the connection among a plurality of driving wave circuits and a plurality of piezoelectric element groups, into which the piezoelectric elements are divided, according to the ejection conditions with analog switches or the like (see Japanese Patent Application Publication Nos. 2001-293856 and 2002-103617). It is thereby possible to suitably use the plurality of drive circuits according to the conditions of the piezoelectric element groups. For example, if some groups have a heavy load and some groups have a light load, the drive circuits can be used so that the load is equalized with the multiplexor circuit or the like of the analog switches.

Otherwise, if the load is extremely light, the amount of electricity consumed by the drive circuits can be suppressed by using part of the plurality of drive circuits and not using the remainder of the drive circuits.

According to the methods proposed in Japanese Patent Application Publication Nos. 2001-293856 and 2002-103617, the drive circuits can certainly be distributed and the circuits can be suitably used according to the driving conditions; therefore, the electricity consumed and the heat generated by the circuits can be suppressed; however, the increase in instantaneous current consumption and the power source capacity of the entire system become problematic depending on the application timing of the driving waves. More specifically, when the driving waves are outputted from the plurality of drive circuits with the same timing, the instantaneous electric current increases as seen from the power source (i.e., looking over the system as a whole), and a sufficiently large power source capacity must be prepared even if the drive circuits themselves are divided and the load on each drive circuit is reduced.

Moreover, a voltage drop cannot be avoided even if the power source capacity is sufficiently increased, because of resistance of the wiring in and around the recording head. It is then possible that the drive energy will be insufficient, ink ejection will be unstable, and the recorded images will be unsatisfactory.

In order to avoid such problems, in one method, the number of nozzles that simultaneously perform ejection is analyzed and calculated on the basis of the image data by a CPU or an image processing ASIC (application-specific integrated circuit), and when the calculated number of nozzles exceeds a specific value, the ejection operation for the exceeding portion is stopped, or is postponed until the next ejection operation (see Japanese Patent Application Publication No. 2002-283556). In another method, the ejection drivers are operated through switch ICs (integrated circuits), and the number of the switches turned on, the electric current flowing through the switch ICs, the temperature, and other such factors are electrically determined by the switch ICs or the like, and ejection is forcibly stopped if a certain condition is exceeded (see Japanese Patent Application Publication No. 2003-291342).

Another method considered for resolving the problems described above with instantaneous current consumption and the power source capacity of the entire system is to divide the multiple nozzles into a plurality of blocks and to perform time-divided driving of driving each block with a separate timing. The instantaneous current consumption is suppressed and brought closer to the average current consumption as a result of driving at separate timings, which makes it possible to reduce the capacity of the power source.

However, when an extremely large number of piezoelectric elements are driven individually with separate timings, the rate of printing decreases, throughput is reduced, although a large throughput is a merit of the line-type recording head, and the properties of the printer are degraded as a result.

SUMMARY OF THE INVENTION

The present invention has been contrived in view of such circumstances, and an object thereof is to provide an image forming apparatus wherein excessive loads on the drive circuits can be reduced and image unevenness resulting from waveform distortion between the drive circuits are also be reduced to improve the image quality, the size of the circuits can be made compact, the power source capacity can be reduced, and the rate of printing can be increased, and to provide a drive control method for a liquid ejection head that is suitable for this apparatus.

In order to attain the aforementioned object, the present invention is directed to an image forming apparatus, comprising: a liquid ejection head which includes a plurality of nozzles and a plurality of pressure generating elements provided correspondingly to the plurality of nozzles, the pressure generating elements being applied with drive signals to eject recording liquid from the corresponding nozzles; a plurality of driving wave generating circuits which generate drive-signal waves for driving the pressure generating elements; a circuit selecting device which selectively switches the driving wave generating circuits to apply the drive-signal waves to the pressure generating elements; a power source which supplies electricity to the pressure generating elements through the driving wave generating circuits; a connection control device which, in accordance with image data representing an image to be formed, selects at least one of the driving wave generating circuits used to drive the pressure generating elements, and controls connection between the at least one of the driving wave generating circuits and the pressure generating elements, so that instantaneous current consumption of each of the driving wave generating circuits falls within a specific allowable value; and a phase control device which controls phases of the drive-signal waves generated by the driving wave generating circuits so that the instantaneous current consumption at the power source falls within a specific upper limit.

According to the present invention, the configuration allows the drive-signal waves from the plurality of driving wave generating circuits to be selectively applied to one pressure chamber element, and the plurality of driving wave generating circuits are selectively used according to the image data, whereby the load borne by the driving wave generating circuits is distributed. Image unevenness resulting from waveform distortion can thereby be suppressed and the rate of printing can be increased because excessive load concentration in one driving wave generating circuit is avoided and the driving wave distortion reduced.

Also, distributing the load makes it possible to distribute the consumed electricity and generated heat created by the driving wave generating circuits, to reduce the size of the circuits, and to reduce the size of the radiator. When the load is borne by two or more driving wave generating circuits, it is more preferable for the loads of the circuits to be substantially equal.

Furthermore, in the present invention, the load can be distributed so that the instantaneous current consumption of the driving wave generating circuits are each within a specific allowable value (first allowable value), and the phases of the plurality of drive-signal waves can be suitably adjusted so that the instantaneous current consumption at the power source (in other words, the instantaneous current consumption of the entire system) is within a specific upper limit (second allowable value).

The drive electric current flowing through the pressure generating elements as the capacitive loads is charged and discharged in the portions of change in the driving wave (rising portion and falling portion). Therefore, a comparatively large drive electric current flows during the times corresponding to rising and falling portions of the drive-signal wave (the times when the waveform has slopes), otherwise there is a small electric current (in flat portions where the waveform has no slope). Therefore, the instantaneous current consumption of the entire system can be reduced by staggering the phases of the plurality of drive-signal waves and preventing the periods of at least one of the rising and falling portions from overlapping each other.

When common driving waves that have a plurality of ejection waveform elements for ejecting a plurality of types of droplets with different volume from the driving wave generating circuits are created, the phases of this plurality of common driving waves are staggered and the waveform element components necessary for ejection are selectively applied to the pressure generating elements from the plurality of common driving waves, which makes high speed deposition possible.

An example of a "pressure generating element" in the present invention is an embodiment wherein piezoelectric elements or other actuators are used to vary the volume of the liquid chambers (pressure chambers) in which the recording liquid is stored, or an embodiment wherein a heater (heating element) that heats to form bubbles in the liquid in the liquid chambers is used.

The "specific allowable values" in the present invention are set in accordance with the driving capabilities of the driving wave generating circuits, for example. The "specific allowable values" may be set separately for the plurality of driving wave generating circuits. When a plurality of driving wave generating circuits with substantially the same drive capabilities are used, the "specific allowable value" commonly applied to the circuits are preferably set in advance.

The "specific upper limit" in the present invention is set according to the power source capacity, the drive capabilities of the driving wave generating circuits, and the like, for example.

In order to attain the aforementioned object, the present invention is also directed to an image forming apparatus, comprising: a liquid ejection head which includes a plurality of nozzles and a plurality of pressure generating elements provided correspondingly to the plurality of nozzles, the pressure generating elements being applied with drive signals to eject recording liquid from the corresponding nozzles; a plurality of driving wave generating circuits which generate drive-signal waves for driving the pressure generating elements; a phase control device which controls phases of the drive-signal waves generated by the driving wave generating circuits; a circuit selecting device which selectively switches the driving wave generating circuits to apply the drive-signal waves to the pressure generating elements; and a connection control device which, in accordance with results of image processing for image data representing an image to be formed, selects at least two of the driving wave generating circuits used to drive the pressure generating elements, and controls connection between the driving wave generating circuits and the pressure generating elements, so that the drive-signal waves are applied from the at least two of the driving wave generating circuits to the pressure elements at timings different from each other, in order to perform ejection of the recording liquid to achieve image formation reflecting the results of image processing.

According to the present invention, staggering the phases of the plurality of drive-signal waves and selectively applying the driving waves to the pressure generating elements with different timings makes it possible to control the grayscaling or deposition positions according to the deposition number of times, to control the deposition intervals, and to obtain image processing effects in the dot arrangement resulting from this deposition.

In order to attain the aforementioned object, the present invention is also directed to an image forming apparatus, comprising: a liquid ejection head which includes a plurality of nozzles and a plurality of pressure generating elements provided correspondingly to the plurality of nozzles, the pressure generating elements being applied with drive signals to eject recording liquid from the corresponding nozzles; a plurality of driving wave generating circuits which generate drive-signal waves for driving the pressure generating elements; a circuit selecting device which selectively switches the driving wave generating circuits to apply the drive-signal waves to the pressure generating elements; and a selection control device which, in accordance with image data representing an image to be formed and with drive histories of the pressure generating elements, selects the driving wave generating circuits used to drive the pressure generating elements, and controls connection between the selected driving wave generating circuits and the pressure generating elements.

When a plurality of driving wave generating circuits are used, nonuniformities can occur in the properties of each circuit even if the drive capabilities of the driving wave generating circuits are set to be substantially equal. Similarly, the plurality of pressure generating elements can also have nonuniformities. Therefore, if the pressure generating elements for specific nozzles are always driven by the same driving wave generating circuits, the image resulting from ejection will display unique characteristics in the combination of the driving wave generating circuits and the nozzles, and it is possible that they will be visible as unevenness in the resulted image.

According to the present invention, the driving wave generating circuits for driving the pressure generating elements can be suitably switched within one image in view of the drive history of the pressure generating elements, and therefore the expressions of the characteristics described above can be distributed over the image, and the occurrence of image unevenness can be suppressed.

The term "drive history" in the present invention includes, for example, information indicating whether the pressure generating elements are being driven (whether the nozzles are ejecting), information indicating which of the driving wave generating circuits are used for driving (information of selecting the driving wave generating circuits during driving), and other such information. An example of an embodiment thereof involves providing a storage device (memory or the like) for storing the history information and performing control so that driving wave generating circuits different from the driving wave generating circuits used in the previous ejection are selected.

In order to attain the aforementioned object, the present invention is also directed to an image forming apparatus, comprising: a liquid ejection head which includes a plurality of nozzles and a plurality of pressure generating elements provided correspondingly to the plurality of nozzles, the pressure generating elements being applied with drive signals to eject recording liquid from the corresponding nozzles; a plurality of driving wave generating circuits which generate drive-signal waves for driving the pressure generating elements; a phase control device which controls phases of the drive-signal waves generated by the driving wave generating circuits; a circuit selecting device which selectively switches the driving wave generating circuits to apply the drive-signal waves to the pressure generating elements; and a connection control device which, in accordance with image data representing an image to be formed, determines positions of the nozzles to be driven, selects the driving wave generating circuits used to drive the pressure generating elements, and controls connection between the selected driving wave generating circuits and the pressure generating elements, so that the pressure generating elements respectively corresponding to the nozzles adjacent to each other are applied with the drive-signal waves of phases different from each other from the driving wave generating circuits different from each other.

In order to attain the aforementioned object, the present invention is also directed to an image forming apparatus, comprising: a liquid ejection head which includes a plurality of nozzles and a plurality of pressure generating elements provided correspondingly to the plurality of nozzles, the pressure generating elements being applied with drive signals to eject recording liquid from the corresponding nozzles; a plurality of driving wave generating circuits which generate drive-signal waves for driving the pressure generating elements; a phase control device which controls phases of the drive-signal waves generated by the driving wave generating circuits; a circuit selecting device which selectively switches the driving wave generating circuits to apply the drive-signal waves to the pressure generating elements; and a connection control device which, in accordance with image data representing an image to be formed, determines positions of the nozzles to be driven, selects the driving wave generating circuits used to drive the pressure generating elements, and controls connection between the selected driving wave generating circuits and the pressure generating elements, so that the pressure generating elements having wires adjacent to each other are applied with the drive-signal waves of phases different from each other from the driving wave generating circuits different from each other.

According to the present invention, the driving wave generating circuits are separated and driving waves with staggered phases are used for pressure generating elements of adjacent nozzles or pressure generating elements having adjacent wires, whereby electrical crosstalk can be reduced. Unevenness resulting from electrical crosstalk can thereby be reduced, and image quality can be improved.

In order to attain the aforementioned object, the present invention is also directed to an image forming apparatus, comprising: a liquid ejection head which includes a plurality of nozzles and a plurality of pressure generating elements provided correspondingly to the plurality of nozzles, the pressure generating elements being applied with drive signals to eject recording liquid from the corresponding nozzles; a plurality of driving wave generating circuits which generate drive-signal waves for driving the pressure generating elements; a phase control device which controls phases of the drive-signal waves generated by the driving wave generating circuits; a circuit selecting device which selectively switches the driving wave generating circuits to apply the drive-signal waves to the pressure generating elements; and a connection control device which, in accordance with image data representing an image to be formed, determines positions of the nozzles to be driven, selects the driving wave generating circuits used to drive the pressure generating elements, and controls connection between the selected driving wave generating circuits and the pressure generating elements, so that the pressure generating elements respectively corresponding to the nozzles adjacent to each other and having a liquid channel in common are applied with the drive-signal waves of phases different from each other from the driving wave generating circuits different from each other.

According to the present invention, the driving wave generating circuits are separated and driving waves with staggered phases are used for pressure generating elements of adjacent nozzles that share the same flow channel, whereby crosstalk (liquid crosstalk) resulting from pressure propagation in the liquid in the flow channel can be reduced. Unevenness resulting from liquid crosstalk can thereby be reduced, and image quality can be improved.

Another possibility is a configuration wherein the above-described examples are combined. Also, another possible example of the configuration of the "liquid ejection head" according to the present invention is a full-line inkjet head that has a nozzle array in which a plurality of nozzles for ejecting ink are arrayed across a length corresponding to the entire width of the recording medium.

In this case, a mode may be adopted in which a plurality of relatively short ejection head blocks having nozzles rows which do not reach a length corresponding to the full width of the recording medium are combined and joined together to be lengthened, thereby forming nozzle rows that correspond to the full width of the recording medium.

A full line type inkjet head is usually disposed in a direction perpendicular to the relative feed direction (relative conveyance direction) of the recording medium, but modes may also be adopted in which the inkjet head is disposed following an oblique direction that forms a prescribed angle with respect to the direction perpendicular to the relative conveyance direction.

The term "recording medium" indicates a medium on which an image is recorded by means of the action of the liquid ejection head (this medium may also be called an ejection receiving medium, print medium, image forming medium, image receiving medium, or the like). This term includes various types of media, irrespective of material and size, such as continuous paper, cut paper, sealed paper, resin sheets, such as OHP sheets, film, cloth, a printed circuit board on which a wiring pattern, or the like, is formed, and an intermediate transfer medium, and the like.

The conveyance device for causing the recording medium and the liquid ejection head to move relative to each other may include a mode where the recording medium is conveyed with respect to a stationary (fixed) liquid ejection head, or a mode where a liquid ejection head is moved with respect to a stationary recording medium, or a mode where both the liquid ejection head and the recording medium are moved.

The term "printing" in the present specification indicates the concept of forming images, with a broad meaning including letters.

In order to attain the aforementioned object, the present invention is also directed to a drive control method for a liquid ejection head which includes a plurality of nozzles and a plurality of pressure generating elements provided correspondingly to the plurality of nozzles, the method comprising the steps of: providing a plurality of driving wave generating circuits which generate drive-signal waves for driving the pressure generating elements to eject recording liquid from the corresponding nozzles; providing a configuration which allows switching of connection relationships between the pressure generating elements and the driving wave generating circuits so as to selectively apply the drive-signal waves from at least two of the driving wave generating circuits to each of the pressure generating elements; in accordance with image data representing an image to be formed, determining a number and positions of the nozzles to be driven, estimating loads on the driving wave generating circuits, and selecting at least one of the driving wave generating circuits used to drive the pressure generating elements, so that instantaneous current consumption of each of the driving wave generating circuits falls within a specific allowable value; controlling connection between the at least one of the driving wave generating circuits and the pressure generating elements; and controlling phases of the drive-signal waves generated by the driving wave generating circuits so that the instantaneous current consumption at a power source falls within a specific upper limit, the power source supplying electricity to the pressure generating elements through the driving wave generating circuits.

In order to attain the aforementioned object, the present invention is also directed to a drive control method for a liquid ejection head which includes a plurality of nozzles and a plurality of pressure generating elements provided correspondingly to the plurality of nozzles, the method comprising the steps of: providing a plurality of driving wave generating circuits which generate drive-signal waves for driving the pressure generating elements to eject recording liquid from the corresponding nozzles; providing a configuration which allows controlling of phases of the drive-signal waves generated by the driving wave generating circuits; providing a configuration which allows switching of connection relationships between the pressure generating elements and the driving wave generating circuits so as to selectively apply the drive-signal waves from at least two of the driving wave generating circuits to each of the pressure generating elements; and in accordance with results of image processing for image data representing an image to be formed, selecting at least two of the driving wave generating circuits used to drive the pressure generating elements, and controlling connection between the driving wave generating circuits and the pressure generating elements, so that the drive-signal waves are applied from the at least two of the driving wave generating circuits to the pressure elements at timings different from each other, in order to perform ejection of the recording liquid to achieve image formation reflecting the results of image processing.

In order to attain the aforementioned object, the present invention is also directed to a drive control method for a liquid ejection head which includes a plurality of nozzles and a plurality of pressure generating elements provided correspondingly to the plurality of nozzles, the method comprising the steps of: providing a plurality of driving wave generating circuits which generate drive-signal waves for driving the pressure generating elements to eject recording liquid from the corresponding nozzles; providing a configuration which allows switching of connection relationships between the pressure generating elements and the driving wave generating circuits so as to selectively apply the drive-signal waves from at least two of the driving wave generating circuits to each of the pressure generating elements; and in accordance with image data representing an image to be formed and with drive histories of the pressure generating elements, selecting the driving wave generating circuits used to drive the pressure generating elements, and controlling connection between the selected driving wave generating circuits and the pressure generating elements, in order to level frequencies of use of the driving wave generating circuits.

In order to attain the aforementioned object, the present invention is also directed to a drive control method for a liquid ejection head which includes a plurality of nozzles and a plurality of pressure generating elements provided correspondingly to the plurality of nozzles, the method comprising the steps of: providing a plurality of driving wave generating circuits which generate drive-signal waves for driving the pressure generating elements to eject recording liquid from the corresponding nozzles; providing a configuration which allows controlling of phases of the drive-signal waves generated by the driving wave generating circuits; providing a configuration which allows switching of connection relationships between the pressure generating elements and the driving wave generating circuits so as to selectively apply the drive-signal waves from at least two of the driving wave generating circuits to each of the pressure generating elements; and in accordance with image data representing an image to be formed, determining positions of the nozzles to be driven, selecting the driving wave generating circuits used to drive the pressure generating elements, and controlling connection between the selected driving wave generating circuits and the pressure generating elements, so that the pressure generating elements respectively corresponding to the nozzles adjacent to each other are applied with the drive-signal waves of phases different from each other from the driving wave generating circuits different from each other.

In order to attain the aforementioned object, the present invention is also directed to a drive control method for a liquid ejection head which includes a plurality of nozzles and a plurality of pressure generating elements provided correspondingly to the plurality of nozzles, the method comprising the steps of: providing a plurality of driving wave generating circuits which generate drive-signal waves for driving the pressure generating elements to eject recording liquid from the corresponding nozzles; providing a configuration which allows controlling of phases of the drive-signal waves generated by the driving wave generating circuits; providing a configuration which allows switching of connection relationships between the pressure generating elements and the driving wave generating circuits so as to selectively apply the drive-signal waves from at least two of the driving wave generating circuits to each of the pressure generating elements; and in accordance with image data representing an image to be formed, determining positions of the nozzles to be driven, selecting the driving wave generating circuits used to drive the pressure generating elements, and controlling connection between the selected driving wave generating circuits and the pressure generating elements, so that the pressure generating elements having wires adjacent to each other are applied with the drive-signal waves of phases different from each other from the driving wave generating circuits different from each other.

In order to attain the aforementioned object, the present invention is also directed to a drive control method for a liquid ejection head which includes a plurality of nozzles and a plurality of pressure generating elements provided correspondingly to the plurality of nozzles, the method comprising the steps of: providing a plurality of driving wave generating circuits which generate drive-signal waves for driving the pressure generating elements to eject recording liquid from the corresponding nozzles; providing a configuration which allows controlling of phases of the drive-signal waves generated by the driving wave generating circuits; providing a configuration which allows switching of connection relationships between the pressure generating elements and the driving wave generating circuits so as to selectively apply the drive-signal waves from at least two of the driving wave generating circuits to each of the pressure generating elements; and in accordance with image data representing an image to be formed, determining positions of the nozzles to be driven, selecting the driving wave generating circuits used to drive the pressure generating elements, and controlling connection between the selected driving wave generating circuits and the pressure generating elements, so that the pressure generating elements respectively corresponding to the nozzles adjacent to each other and having a liquid channel in common are applied with the drive-signal waves of phases different from each other from the driving wave generating circuits different from each other.

According to the present invention, the load on the driving wave generating circuits can be controlled, image unevenness resulting from the driving wave distortion can be suppressed, and the rate of printing can be increased because of a configuration provided with a plurality of driving wave generating circuits, wherein these driving wave generating circuits can be appropriately used in a selective manner on the basis of image data. Also, distributing the load makes it possible to distribute the consumed electricity and the generated heat created by the driving wave generating circuits, and to reduce the size of the circuits and the radiator. Furthermore, not only can the instantaneous current consumption of the driving wave generating circuits be reduced, but the instantaneous current consumption (of the power source) of the entire system an also be reduced by suitably controlling the phases of the plurality of drive-signal waves.

According to another embodiment of the present invention, the phases of the plurality of drive-signal waves are staggered, and the driving waves are selectively applied to the pressure generating elements at different timings, whereby the image processing effects can be obtained.

According to another embodiment of the present invention, it is possible to suppress the occurrence of image unevenness resulting from nonuniformities in the driving wave generating circuits or nonuniformities in the pressure generating elements, because the driving wave generating circuits are selected in view of the driving history of the pressure generating elements.

Also, according to another embodiment of the present invention, unevenness resulting from electrical crosstalk can be reduced and image quality can be improved by applying driving waves with staggered phases from different driving wave generating circuits for pairs of pressure generating elements of adjacent nozzles or pairs of pressure generating elements having adjacent wires.

Furthermore, according to another embodiment of the present invention, unevenness resulting from liquid crosstalk can be reduced and image quality can be improved by applying driving waves with staggered phases from different driving wave generating circuits for pressure generating elements of adjacent nozzles that share the same flow channel.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 15 is a flowchart showing a second embodiment of a print control in the inkjet recording apparatus;

DETAILED DESCRIPTION OF THE PREFERRED EMBODIMENTS

General Configuration of Inkjet Recording Apparatus

Figure 1:
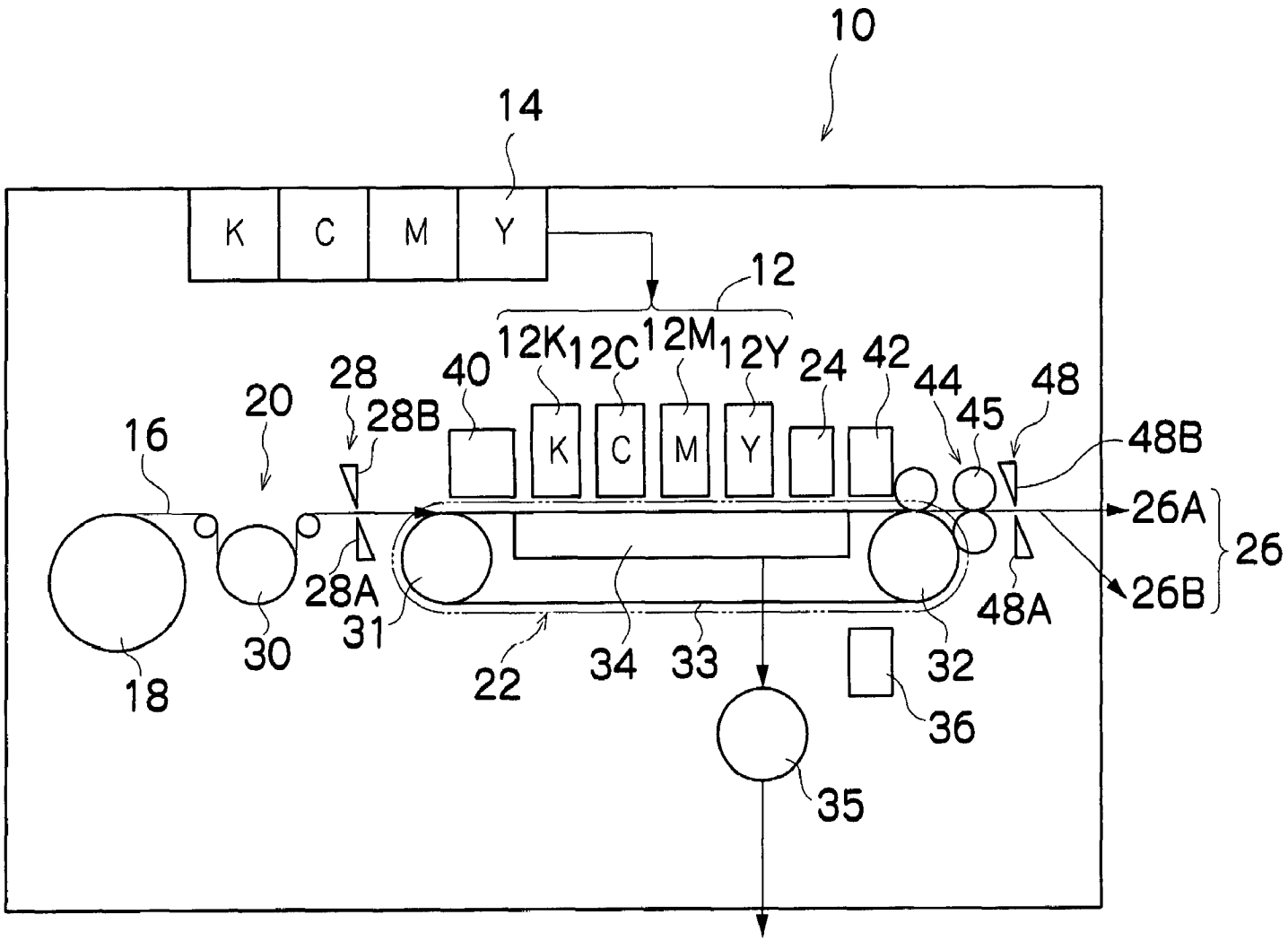
FIG. 1 is a general configuration diagram of an inkjet recording apparatus according to an embodiment of the present invention.

FIG. 1 is a general configuration diagram of an inkjet recording apparatus including an image forming apparatus according to an embodiment of the present invention. As shown in FIG. 1, the inkjet recording apparatus 10 comprises: a printing unit 12 having a plurality of inkjet heads (hereafter, called "heads") 12K, 12C, 12M, and 12Y provided for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16 which is a recording medium; a decurling unit 20 removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

The ink storing and loading unit 14 has ink tanks for storing the inks of K, C, M and Y to be supplied to the heads 12K, 12C, 12M, and 12Y, and the tanks are connected to the heads 12K, 12C, 12M, and 12Y by means of prescribed channels. The ink storing and loading unit 14 has a warning device (for example, a display device or an alarm sound generator) for warning when the remaining amount of any ink is low, and has a mechanism for preventing loading errors among the colors.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (not shown in FIG. 1, but shown in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
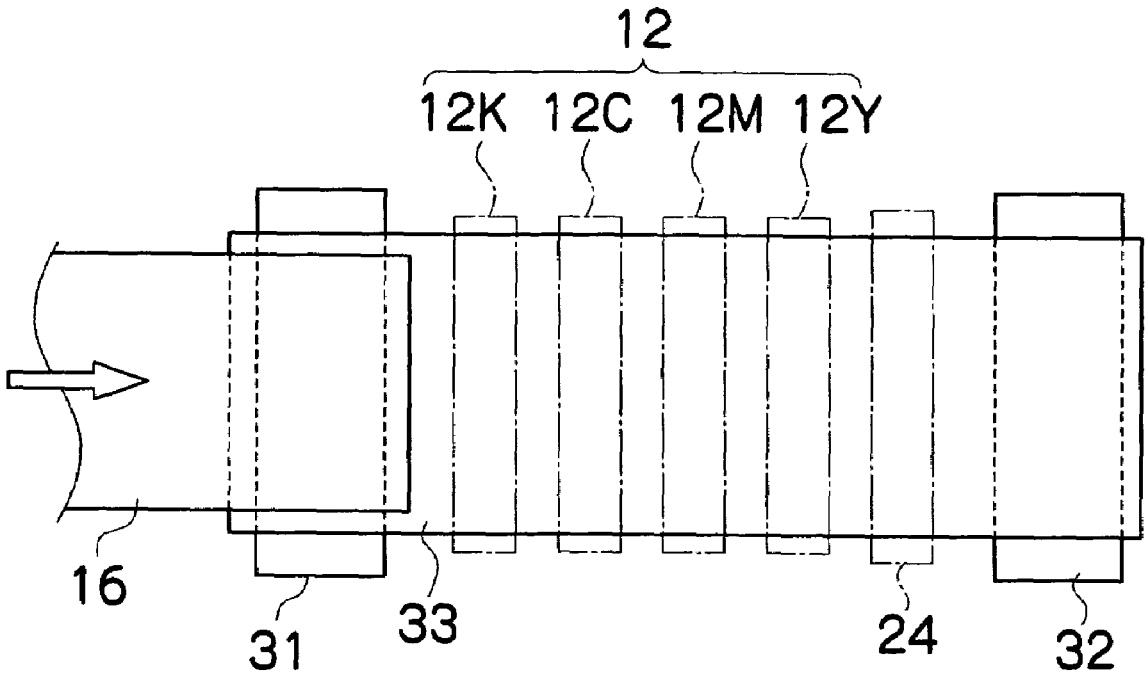
FIG. 2 is a plan view of the principal part of the peripheral area of a print unit in the inkjet recording apparatus illustrated in FIG. 1.

The heads 12K, 12C, 12M and 12Y of the printing unit 12 are full line heads having a length corresponding to the maximum width of the recording paper 16 used with the inkjet recording apparatus 10, and comprising a plurality of nozzles for ejecting ink arranged on a nozzle face through a length exceeding at least one edge of the maximum-size recording medium (namely, the full width of the printable range) (see FIG. 2).

The print heads 12K, 12C, 12M and 12Y are arranged in color order (black (K), cyan (C), magenta (M), yellow (Y)) from the upstream side in the feed direction of the recording paper 16, and these respective heads 12K, 12C, 12M and 12Y are fixed extending in a direction substantially perpendicular to the conveyance direction of the recording paper 16.

A color image can be formed on the recording paper 16 by ejecting inks of different colors from the heads 12K, 12C, 12M and 12Y, respectively, onto the recording paper 16 while the recording paper 16 is conveyed by the suction belt conveyance unit 22.

By adopting a configuration in which the full line heads 12K, 12C, 12M and 12Y having nozzle rows covering the full paper width are provided for the respective colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The print determination unit 24 shown in FIG. 1 has an image sensor for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

A test pattern or the target image printed by the print heads 12K, 12C, 12M, and 12Y of the respective colors is read in by the print determination unit 24, and the ejection performed by each head is determined. The ejection determination includes detection of the ejection, measurement of the dot size, and measurement of the dot formation position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of the Head

Next, the structure of a head will be described. The heads 12K, 12C, 12M and 12Y of the respective ink colors have the same structure, and a reference numeral 50 is hereinafter designated to any of the heads.

Figure 3A:
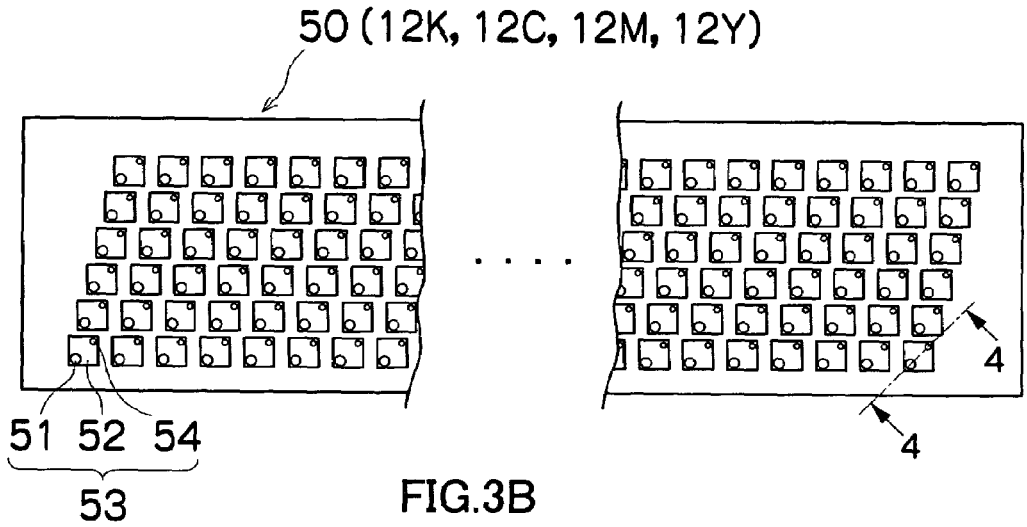
FIG. 3A is a perspective plan view showing an example of the composition of a print head.
Figure 3B:
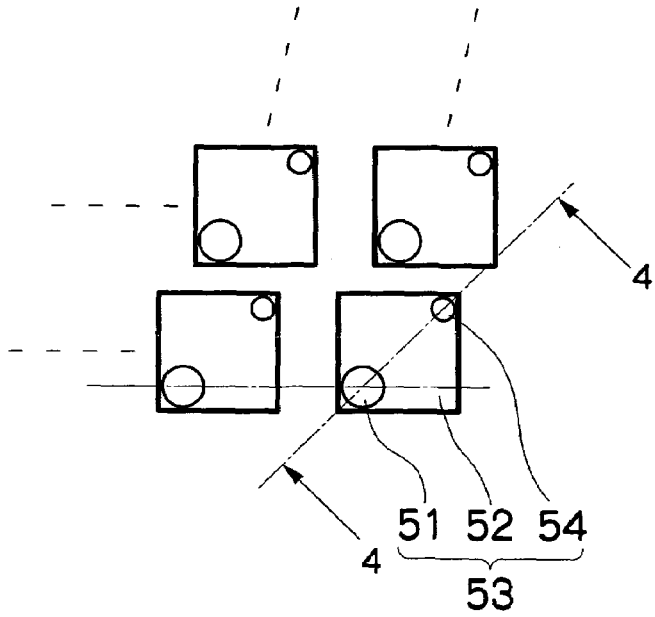
FIG. 3B is a principal enlarged view of FIG. 3A.
Figure 3C:
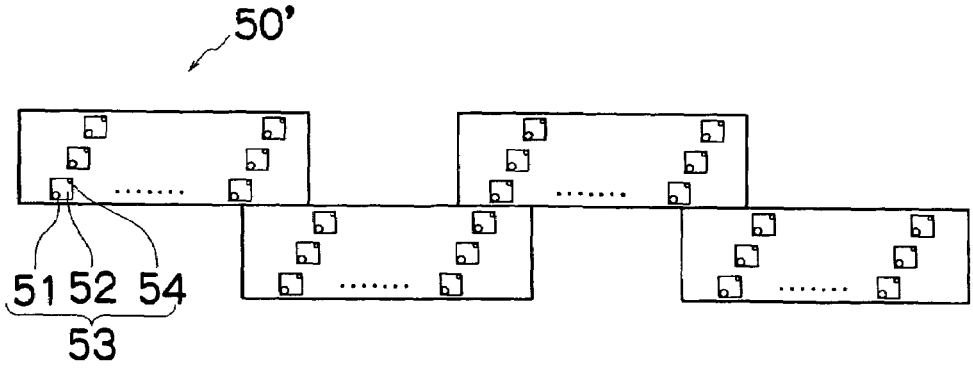
FIG. 3C is a perspective plan view showing another example of the configuration of a full line head.
Figure 4:
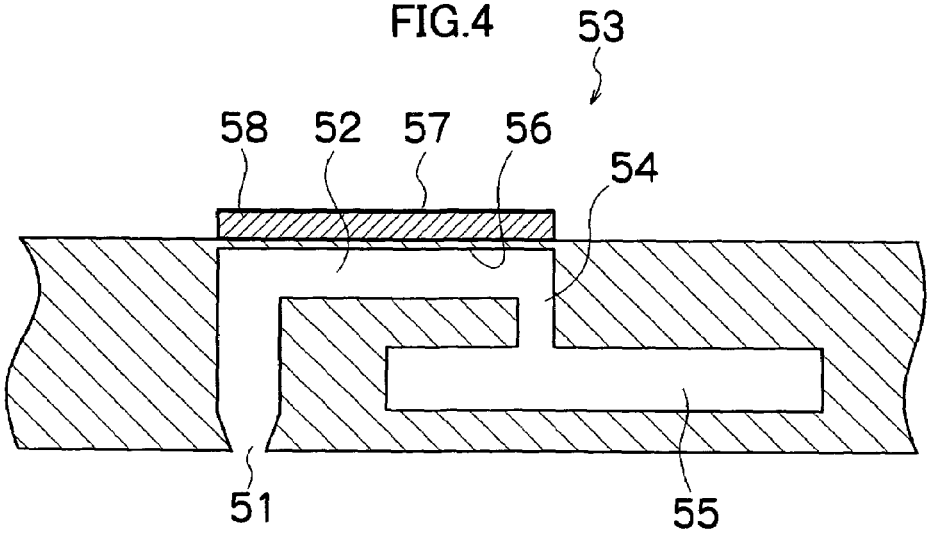
FIG. 4 is a cross-sectional view along line 4-4 in FIGS. 3A and 3B.

FIG. 3A is a perspective plan view showing an example of the configuration of the head 50, FIG. 3B is an enlarged view of a portion thereof, FIG. 3C is a perspective plan view showing another example of the configuration of the head 50, and FIG. 4 is a cross-sectional view taken along the line 4-4 in FIGS. 3A and 3B, showing the inner structure of a droplet ejection element (an ink chamber unit for one nozzle 51).

The nozzle pitch in the head 50 should be minimized in order to maximize the density of the dots printed on the surface of the recording paper 16. As shown in FIGS. 3A and 3B, the head 50 according to the present embodiment has a structure in which a plurality of ink chamber units (droplet ejection elements) 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the recording paper 16 in a direction substantially perpendicular to the conveyance direction of the recording paper 16 is not limited to the example described above. For example, instead of the configuration in FIG. 3A, as shown in FIG. 3C, a line head having nozzle rows of a length corresponding to the entire width of the recording paper 16 can be formed by arranging and combining, in a staggered matrix, short head blocks 50' having a plurality of nozzles 51 arrayed in a two-dimensional fashion.

As shown in FIGS. 3A and 3B, the planar shape of the pressure chamber 52 provided for each nozzle 51 is substantially a square, and an outlet to the nozzle 51 and an inlet of supplied ink (supply port) 54 are disposed in both corners on a diagonal line of the square.

As shown in FIG. 4, each pressure chamber 52 is connected to a common channel 55 through the supply port 54. The common channel 55 is connected to an ink tank 60 (not shown in FIG. 4, but shown in FIG. 6), which is a base tank that supplies ink, and the ink supplied from the ink tank 60 is delivered through the common flow channel 55 in FIG. 4 to the pressure chambers 52.

An actuator 58 provided with an individual electrode 57 is bonded to a pressure plate 56 (a diaphragm that also serves as a common electrode) which forms the ceiling of the pressure chamber 52. When a drive voltage is applied to the individual electrode 57, the actuator 58 is deformed, the volume of the pressure chamber 52 is thereby changed, and the pressure in the pressure chamber 52 is thereby changed, so that the ink inside the pressure chamber 52 is thus ejected through the nozzle 51. The actuator 58 is preferably a piezoelectric element. When ink is ejected, new ink is supplied to the pressure chamber 52 from the common flow channel 55 through the supply port 54.

Figure 5:
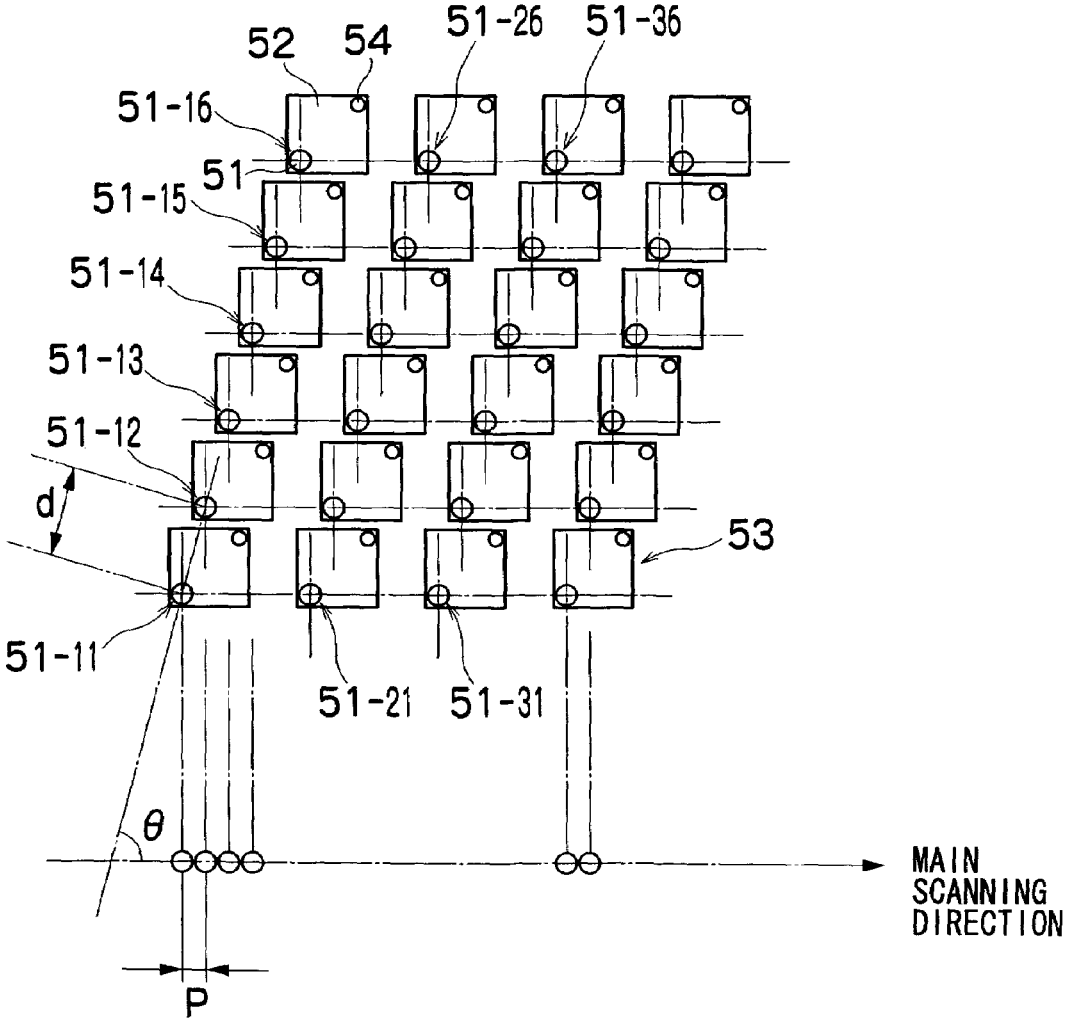
FIG. 5 is an enlarged view showing a nozzle arrangement in the print head illustrated in FIG. 3A.

As shown in FIG. 5, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is d×cos θ, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block; . . . ); and one line is printed in the width direction of the recording paper 16 by sequentially driving the nozzles 51-11, 51-12, . . . , 51-16 in accordance with the conveyance velocity of the recording paper 16.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

In implementing the present invention, the arrangement of the nozzles is not limited to that of the example illustrated. Moreover, a method is employed in the present embodiment where an ink droplet is ejected by means of the deformation of the actuator 58, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Configuration of Ink Supply System

Figure 6:
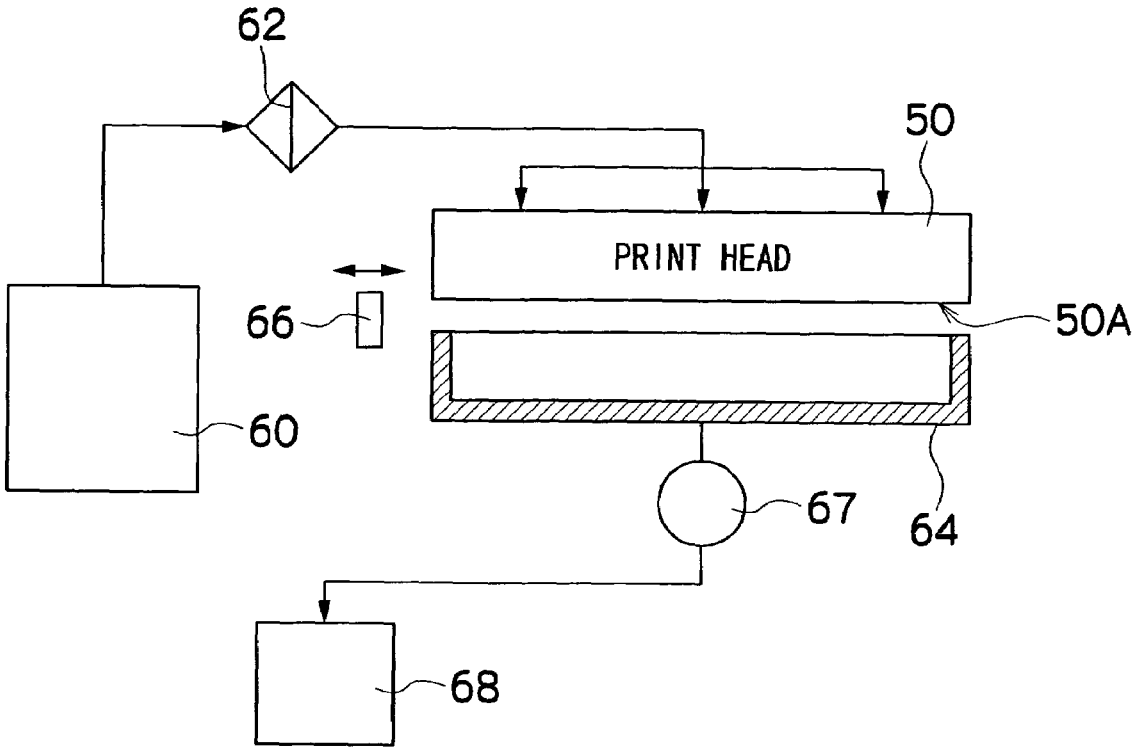
FIG. 6 is a schematic drawing showing the configuration of an ink supply system in the inkjet recording apparatus.

FIG. 6 is a schematic drawing showing the configuration of the ink supply system in the inkjet recording apparatus 10. The ink tank 60 is a base tank that supplies ink to the head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 6 is equivalent to the ink storing and loading unit 14 in FIG. 1 described above.

A filter 62 for removing foreign matters and bubbles is disposed between the ink tank 60 and the head 50 as shown in FIG. 6. The filter mesh size in the filter 62 is preferably equivalent to or less than the diameter of the nozzle and commonly about 20 μm. Although not shown in FIG. 6, it is preferable to provide a sub-tank integrally to the print head 50 or nearby the head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit including the cap 64 and the cleaning blade 66 can be relatively moved with respect to the head 50 by a movement mechanism (not shown), and is moved from a predetermined holding position to a maintenance position below the head 50 as required.

The cap 64 is displaced up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face 50A is thereby covered with the cap 64.

The cleaning blade 66 is composed of rubber or another elastic member, and can slide on the ink ejection surface (surface of the nozzle plate) of the head 50 by means of a blade movement mechanism (not shown). When ink droplets or foreign matter has adhered to the nozzle plate, the surface of the nozzle plate is wiped and cleaned by sliding the cleaning blade 66 on the nozzle plate.

During printing or standby, when the frequency of use of specific nozzles is reduced and ink viscosity increases in the vicinity of the nozzles, a preliminary discharge is made to eject the degraded ink toward the cap 64.

Also, when bubbles have become intermixed in the ink inside the head 50 (inside the pressure chamber 52), the cap 64 is placed on the head 50, the ink inside the pressure chamber 52 (the ink in which bubbles have become intermixed) is removed by suction with a suction pump 67, and the suction-removed ink is sent to a collection tank 68. This suction action entails the suctioning of degraded ink whose viscosity has increased (hardened) also when initially loaded into the head 50, or when service has started after a long period of being stopped.

When a state in which ink is not ejected from the head 50 continues for a certain amount of time or longer, the ink solvent in the vicinity of the nozzles 51 evaporates and ink viscosity increases. In such a state, ink can no longer be ejected from the nozzle 51 even if the actuator 58 for the ejection driving is operated. Before reaching such a state (in a viscosity range that allows ejection by the operation of the actuator 58) the actuator 58 is operated to perform the preliminary discharge to eject the ink whose viscosity has increased in the vicinity of the nozzle toward the ink receptor. After the nozzle surface is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be ejected by the preliminary discharge, and a suctioning action is carried out as follows.

More specifically, when bubbles have become intermixed in the ink inside the nozzle 51 and the pressure chamber 52, ink can no longer be ejected from the nozzle 51 even if the actuator 58 is operated. Also, when the ink viscosity inside the nozzle 51 has increased over a certain level, ink can no longer be ejected from the nozzle 51 even if the actuator 58 is operated. In these cases, a suctioning device to remove the ink inside the pressure chamber 52 by suction with a suction pump, or the like, is placed on the nozzle face 50A of the head 50, and the ink in which bubbles have become intermixed or the ink whose viscosity has increased is removed by suction.

However, since this suction action is performed with respect to all the ink in the pressure chambers 52, the amount of ink consumption is considerable. Therefore, a preferred aspect is one in which a preliminary discharge is performed when the increase in the viscosity of the ink is small.

Description of Control System

Figure 7:
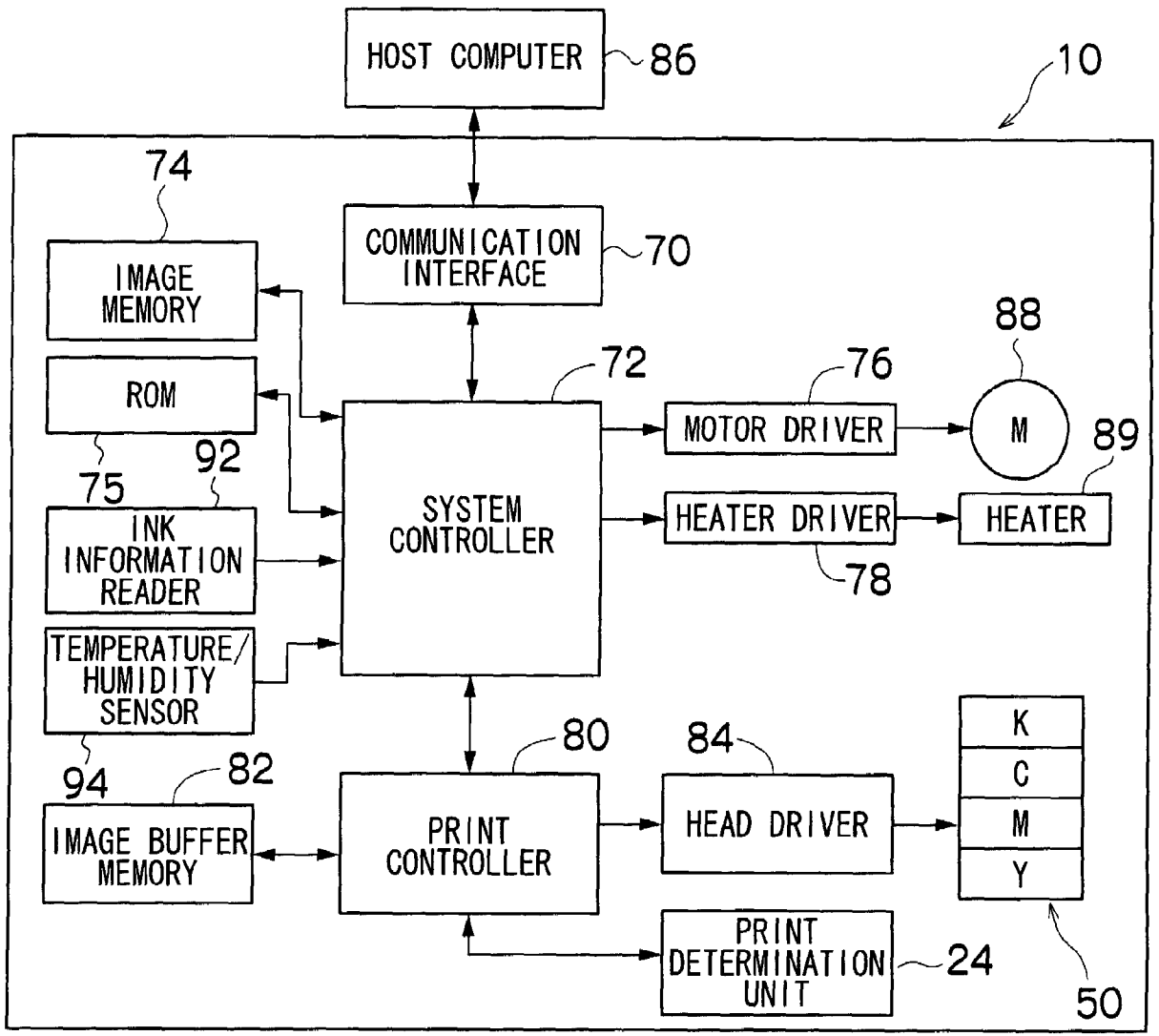
FIG. 7 is a principal block diagram showing the system composition of the inkjet recording apparatus.

FIG. 7 is a principal block diagram showing the system configuration of the inkjet recording apparatus 10. The inkjet recording apparatus 10 comprises a communication interface 70, a system controller 72, an image memory 74, a ROM 75, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74, and it also generates control signals for controlling the motor 88 and heater 89 of the conveyance system.

The program executed by the CPU of the system controller 72 and the various types of data which are required for control procedures are stored in the ROM 75. The ROM 75 may be a non-writeable storage device, or it may be a rewriteable storage device, such as an EEPROM. The image memory 74 is used as a temporary storage region for the image data, and it is also used as a program development region and a calculation work region for the CPU.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print data (dot data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators 58 of the heads of the respective colors 12K, 12C, 12M and 12Y on the basis of print data supplied by the print controller 80. The head driver 84A can be provided with a feedback control system for maintaining constant drive conditions for the print heads.

The image data to be printed is externally inputted through the communication interface 70, and is stored in the image memory 74. In this stage, the RGB image data is stored in the image memory 74.

The image data stored in the image memory 74 is sent to the print controller 80 through the system controller 72, and is converted to the dot data for each ink color by means of the method according to the embodiment of the present invention, in the print controller 80. In other words, the print controller 80 performs processing for converting the inputted RGB image data into dot data for four colors, K, C, M and Y. The dot data generated by the print controller 80 is stored in the image buffer memory 82.

The head driver 84 generates drive control signals for the head 50 on the basis of the dot data stored in the image buffer memory 82. By supplying the drive control signals generated by the head driver 84 to the head 50, ink is ejected from the head 50. By controlling ink ejection from the heads 50 in synchronization with the conveyance velocity of the recording paper 16, an image is formed on the recording paper 16.

The print determination unit 24 is a block that includes the line sensor as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 80.

According to requirements, the print controller 80 makes various corrections with respect to the head 50 on the basis of information obtained from the print determination unit 24. Furthermore, the system controller 72 implements control for carrying out preliminary ejection, suctioning, and other prescribed restoring processes on the head 50, on the basis of the information obtained from the print determination unit 24.

The inkjet recording apparatus 10 of the present embodiment further includes an ink information reader 92 and a temperature/humidity sensing device 94. The ink information reader 92 is a device for acquiring information of the type of ink. More specifically, for example, a device that reads information for the ink properties from the shape of the cartridge in the ink tank 60 (a specified shape whereby the ink type can be identified), or a barcode or IC chip incorporated in the cartridge, can be used. Otherwise, the operator may input the necessary information using a user interface.

The temperature/humidity sensing device 94 is a block containing sensors for measuring the temperature and humidity of the area where the inkjet recording apparatus 10 is installed, sensors for measuring the temperature of the ink, and other such detection devices.

The information obtained from the ink information reader 92, the temperature/humidity sensing device 94, and other such devices is sent to the system controller 72 and is used to control ink ejection (to control the ejection amount and ejection timing) and for other such purposes.

Figure 8:
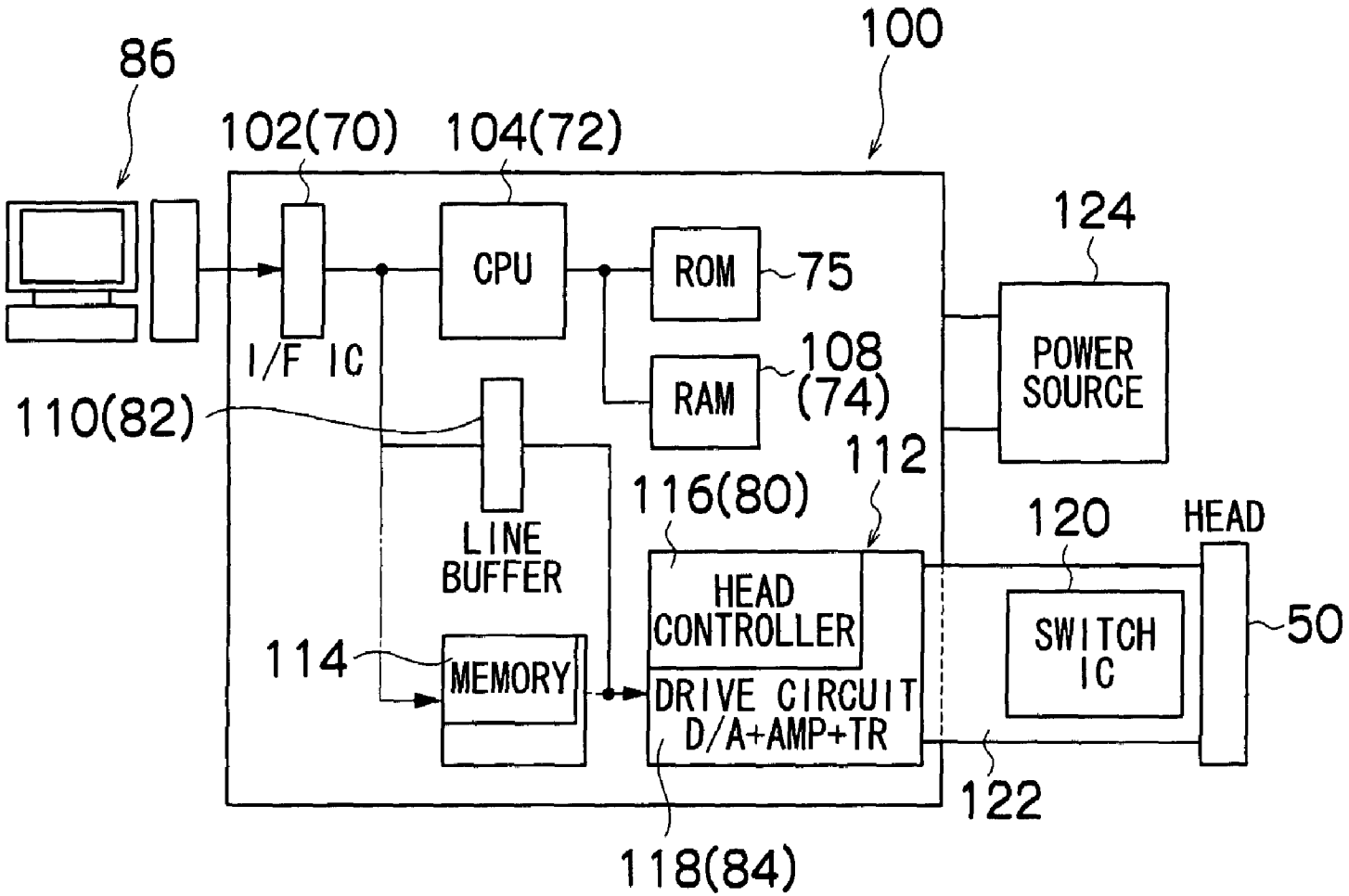
FIG. 8 is a principal structural diagram of the primary circuits involved in driving the head in the inkjet recording apparatus.

Next, the drive method for the head 50 in the inkjet recording apparatus 10 of the present embodiment will be described. FIG. 8 is a principal structural view of the primary circuits involved in driving the head in the inkjet recording apparatus 10. A communication interface IC 102, a CPU 104, a ROM 75, a RAM 108, a line buffer 110, and a driver IC 112 are mounted on the circuit board 100 installed in the inkjet recording apparatus 10.

The communication interface IC 102 is equivalent to the communication interface indicated by the reference numeral 70 in FIG. 7. The CPU 104 in FIG. 8 functions as the system controller 72 described in FIG. 7. The RAM 108 in FIG. 8 functions as the image memory 74 described in FIG. 7, and the line buffer 110 in FIG. 8 functions as the image buffer memory 82 in FIG. 7. A memory 114 can be provided in place of or in addition to the line buffer 110. Apart of the RAM 108 can also serve as the memory 114.

The driver IC 112 shown in FIG. 8 is configured including a head controller 116 (equivalent to the print controller 80 described in FIG. 7), and a drive circuit element 118 including a D/A converter, an amplifier, a transistor, and the like (equivalent to the head driver 84 described in FIG. 7). The details of the driver IC 112 will be described later with reference to FIG. 9. The driver IC 112 in FIG. 8 is electrically connected to the head 50 via wiring members (for example, wiring members with a combination of flexible cables and rigid boards) 122 on which a switch IC 120 is mounted.

The switch IC 120 is configured including a serial/parallel (S/P) conversion circuit and a switch element array. A power source circuit 124 is connected to the circuit board 100, and electricity is supplied to the circuit blocks from the power source circuit 124.

Figure 9:
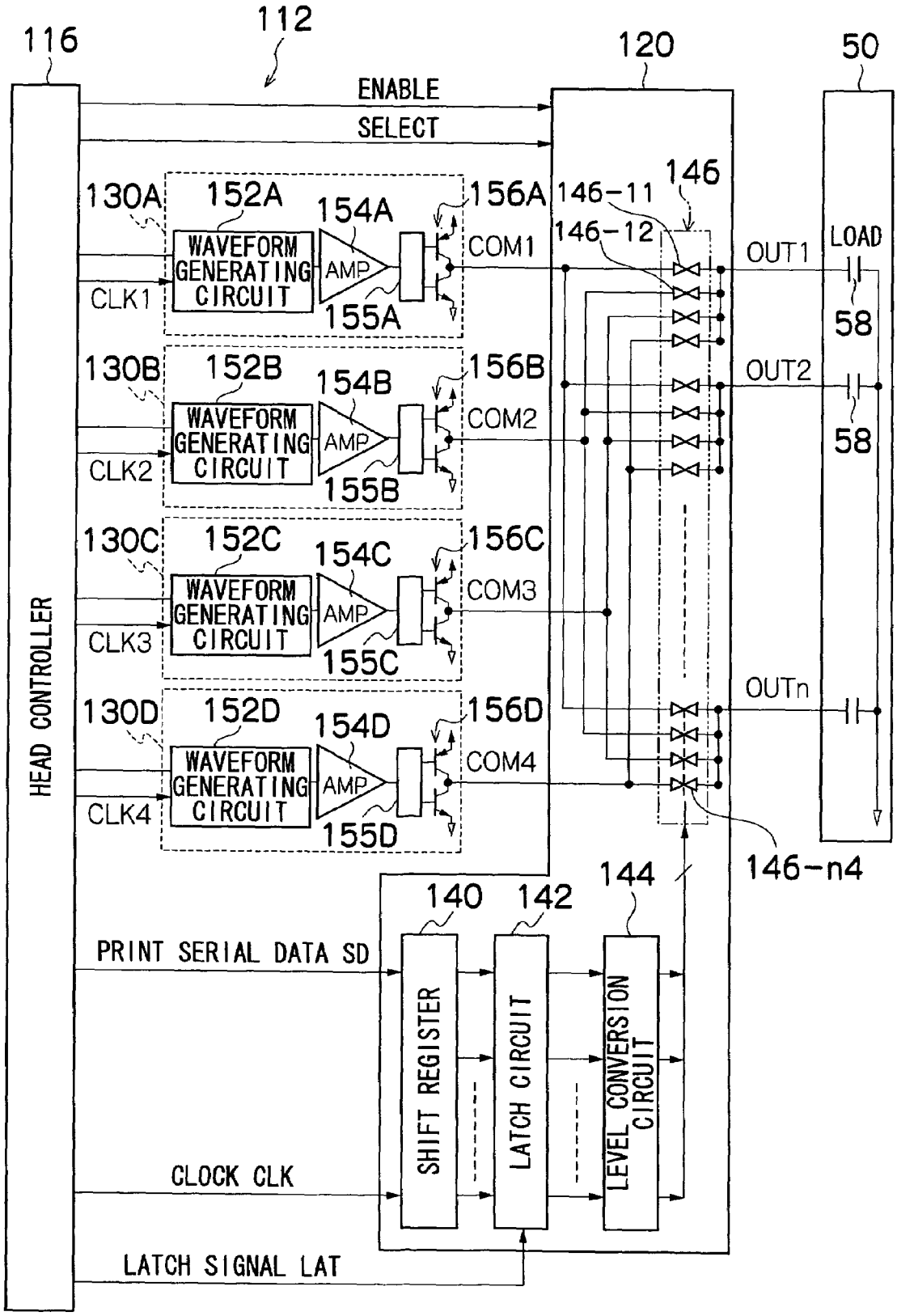
FIG. 9 is a principal structural diagram of a driver IC and a switch IC.

FIG. 9 is a principal structural diagram of the driver IC 112 including the head controller 116 and the switch IC 120. The driver IC 112 primarily includes the head controller 116, a first driving wave generating circuit 130A, a second driving wave generating circuit 130B, a third driving wave generating circuit 130C, and a fourth driving wave generating circuit 130D.

The switch IC 120 further includes a shift register 140, a latch circuit 142, a level conversion circuit 144, and a switch element array 146, and functions as a selecting circuit for selectively applying driving waves from the driving wave generating circuits 130A-130D to the actuators 58 of the head 50. In FIG. 9, the actuators (piezoelectric elements) 58 of the head 50 are shown as the capacitive loads with the reference numerals OUT1, OUT2, . . . , OUTn. The individual electrodes 57 of the actuators 58 (the electrodes on the left-hand side in the capacitive loads shown in FIG. 9) are connected to the terminals of the corresponding switch elements 146-*ij* (i=1, 2, . . . , n, and j=1, 2, 3, 4), and the other electrodes (the common electrodes) of the actuators 58 are connected to a ground line (GND).

In the present embodiment, the switch IC 120 functions as a "circuit selecting device," and the head controller 116 functions as a "connection control device" and a "phase control device."

The driving wave generating circuits 130A to 130D are configured from wave generating circuits 152A to 152D that include D/A converters (DAC) for converting the digital waveform data outputted from the head controller 116 to analog signals in accordance with the clock signals CLK1 to CLK4, amplifier circuits 154A to 154D for amplifying the driving waves according to the output levels of the wave generating circuits 152A to 152D, charging and discharging circuits 155A to 155D, and push-pull circuits 156A to 156D. The digital waveform data of the driving waves for ejection output from the head controller 116 is inputted to the wave generating circuits 152A to 152D, and is converted to analog wave signals corresponding to the inputted waveform data in the wave generating circuits 152A to 152D. The analog wave signals are amplified to a specific level by the amplifier circuits 154A to 154D and are amplified in power using the push-pull circuits 156A to 156D, and then are outputted as drive-signal waves. The common driving waves thus created are inputted to ports COM1 to COM4 of the switch IC 120. The inkjet recording apparatus 10 of the present embodiment includes four separate drive circuits shown by the reference numerals 130A to 130D.

The switch IC 120 is a circuit (multiplexor) for selectively switching the connection relationship between the ports COM1 to COM4 and the actuators 58 (OUT1, OUT2, . . . OUTn) on the basis of the control signals sent from the head controller 116.

The port COM1 is connected to the input side terminals of the switch elements 146-*i*1 (i=1, 2, . . . , n), and similarly, the port COM2 is connected to the input side terminals of the switch elements 146-*i*2 (i=1, 2, . . . , n), the port COM3 is connected to the input side terminals of the switch elements 146-*i*3 (i=1, 2, . . . , n), and the port COM4 is connected to the input side terminals of the switch elements 146-*i*4 (i=1, 2, . . . , n). The actuators (piezoelectric elements) 58 or OUTi (i=1, 2, . . . , n) are connected to the output side terminals of the switch elements 146-*i*1 to 146-*i*4 (i=1, 2, . . . , n), and are configured so that drive signals can be selectively applied to the actuators (OUT1) by controlling the turning on and off of the switch elements 146-*i*1 to 146-*i*4.

In other words, one actuator 58 is configured so that a drive circuit can be selected from among the four driving wave generating circuits 130A to 130D according to the conditions. Although a specific example of controlling will be described later, it is known which nozzles are driven and how much ink is ejected while data is processed to analyze the image data for printing and to eject the ink, and the load is then distributed among the driving wave generating circuits 130A to 130D (hereinafter also denoted simply as "drive circuits" for the sake of convenience) and is controlled so that the load is substantially uniform for each circuit, so that stable ink ejection is achieved.

Sometimes the load is small depending on the image data, in which case some of the plurality of driving wave generating circuits 130A to 130D can be halted in order to lessen power consumption.

This method of appropriately selecting the plurality of driving wave generating circuits 130A to 130D on the basis of the image data allows the number of circuits and the required number of radiators to be reduced. Depending on the type of ink and the conditions of the print mode, it is further possible to reduce the number of drive circuits by about ⅓ compared to a conventional configuration. Also, since the operating drive circuits can be appropriately selected according to the load conditions based on the image data, waveform distortion resulting from the load fluctuations can be reduced, and waveform nonuniformities between the drive circuits can be reduced. It is thereby possible to suppress deterioration in image quality resulting from load fluctuations.

The head controller 116 shown in FIG. 9 sends the digital waveform data and the clock signals CLK1 to CLK4 to the driving wave generating circuits 130A to 130D, and also sends the control signals ("Enable," "Select," or the like) to the switch IC 120. Also, the head controller 116 creates print data developed into dot patterns on the basis of the image information sent from the host computer 86 (see FIG. 8), and also creates a clock signal (CLK) for serial transmission and a latch signal (LAT) for controlling the latch timing. The print data created by the head controller 116 in FIG. 9 is transmitted (serial transmission) along with the clock signal CLK to the shift register 140 as print serial data SD in synchronization with the clock signal CLK. The print data stored in the shift register 140 is latched by the latch circuit 142 on the basis of the latch signal LAT outputted from the head controller 116.

The signals latched by the latch circuit 142 are converted in the level conversion circuit 144 to specific voltage values at which the switch elements 146-*ij* (i=1, 2, . . . , n, and j=1, 2, 3, 4) can be driven. The turning on and off of the switch elements 146-*ij* (i=1, 2, . . . n, and j=1, 2, 3, 4) is controlled by the output signals of the level conversion circuit 144.

Figure 10A:
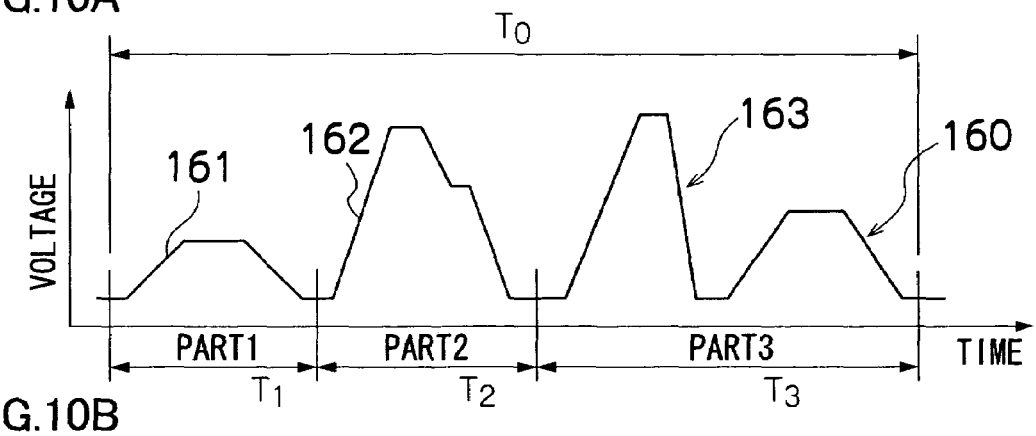
FIGS. 10A to 10E are waveform diagrams showing an example of a common driving wave.

FIG. 10A is a waveform diagram showing an example of the common driving wave outputted from the driving wave generating circuits 130A to 130D. As shown in FIG. 10A, the common driving wave 160 is composed of a structure obtained by continuously joining a microvibration waveform element 161 (the pulse component "part 1" in FIG. 10A) that causes a meniscus of the ink in the nozzle to vibrate by keeping the energy to an amount that does not eject the ink, a first ejection waveform element 162 (the pulse component "part 2" in FIG. 10A) for ejecting an ink droplet (for example, 3 pl) for a small dot, and a second ejection waveform element 163 (the pulse component "part 3" in FIG. 10A) for ejecting an ink droplet (for example, 6 pl) for a medium dot. The waveform of the combination of these three waveform elements 161 to 163 is repeated at specific cycles $T_0$.

Controlling the turning on and off of the switch elements 146-*ij* (i=1, 2, . . . , n, and j=3, 4) described in FIG. 9 makes it possible to selectively apply the microvibration waveform element 161, the first ejection waveform element 162, and/or the second ejection waveform element 163 from the common driving wave 160 shown in FIG. 10A with the actuators 58 of the nozzles 51.

Figure 10B:
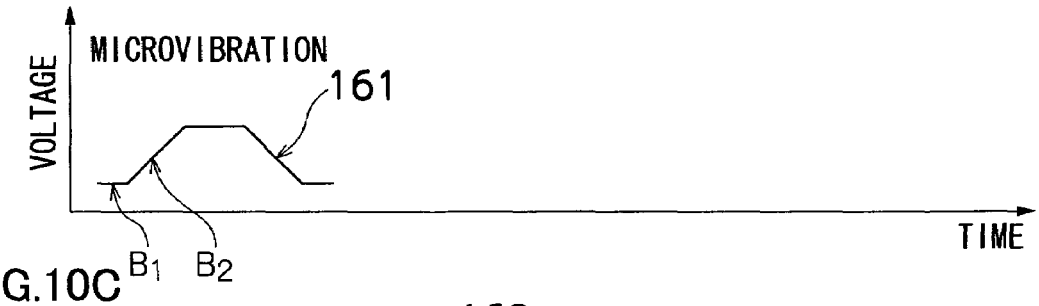

The microvibration waveform element 161 shown in FIG. 10B is a waveform with a lower amplitude (voltage) than the other ejection waveform elements 162 and 163. When the microvibration waveform element 161 is applied to the actuator 58, the meniscus of the ink in the vicinity of the nozzle 51 slightly vibrates to an extent that causes no ejection of the ink, and thickening of the ink is suppressed.

Figure 10C:
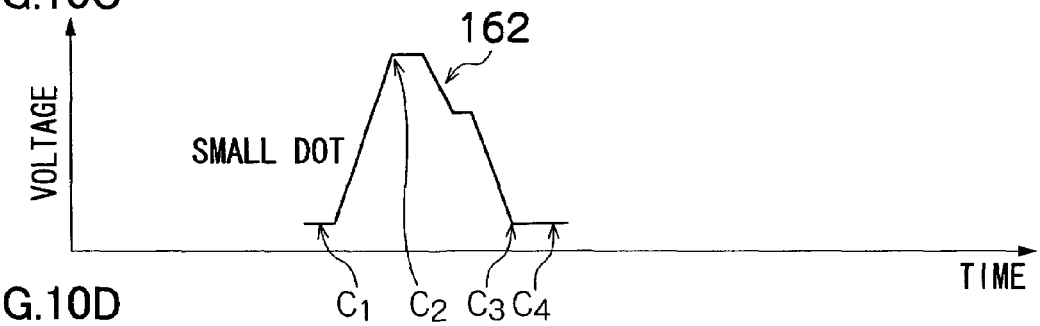
Figure 10D:
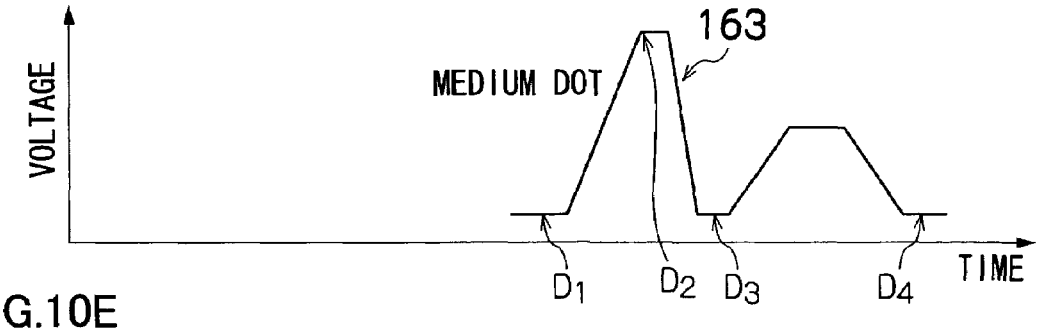

When the first ejection waveform element 162 shown in FIG. 10C is applied to the actuator 58, a droplet of the ink to form a small dot is ejected. When only the second ejection waveform element 163 shown in FIG. 10D is applied to the actuator 58, a droplet of the ink to form a medium dot is ejected. Also, as shown in FIG. 10E, when the first ejection waveform element 162 and the second ejection waveform element 163 are continuously applied to the actuator 58, droplets (for example, 9 pl in total) for a large dot are ejected.

Figure 10E:
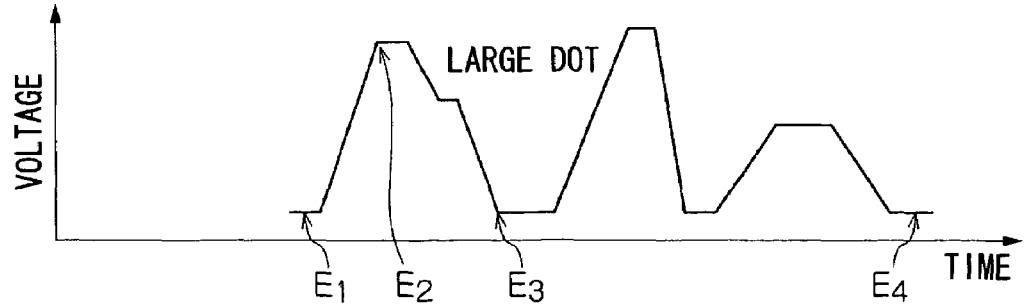

Although the timings (ejection timings) at which the driving waves are applied within the driving wave cycle $T_0$ changes according to the volume of droplets ejected as shown in FIGS. 10C to 10E, the difference in deposited positions of the small dots and the medium dots resulting from this time difference is within a range that can be substantially regarded as one pixel of the image on the recording medium.

In the example shown in FIG. 10A, a waveform period $T_1$ of the microvibration waveform element 161, a waveform period $T_2$ of the first ejection waveform element 162, and a waveform period $T_3$ of the second ejection waveform element 163 have the relationship $T_1=T_2=T_3/2$. When implementing the present invention, the relationship between the waveform periods of the waveform elements is not limited to this example. Setting the waveform period $T_1$ of the microvibration waveform element 161 to 1/N of the driving wave cycle $T_0$, where N is a positive integer, makes it easy to control the timings at which the microvibration waveforms are applied, which is preferred in terms of control.

In the waveform diagrams in FIGS. 10B to 10E, the reference numerals B1 and B2, C1 to C4, D1 to D4, and E1 and E4 denote that, by representing the letters "B" to "E" by the letter "n" (i.e., n=B, C, D, E), "n1" corresponds to a static state of the meniscus, "n2" corresponds to the pull-in of the meniscus, "n3" corresponds to the push-out of the meniscus (i.e., ejection), and "n4" corresponds to preparing for the next ejection.

The ejecting nozzles and non-ejecting nozzles are determined in accordance with the print data, and any of the ejection waveform elements in FIGS. 10C to 10E are applied to the nozzles that perform ejection. Also, the microvibration waveform elements shown in FIG. is 10B are applied at appropriate timings to part or all of the nozzles that do not perform ejection.

When a piezoelectric element is driven, the drive current flowing through the piezoelectric element is commonly charged and discharged during the rise and fall of the driving wave. More specifically, a large drive current flows during the short times in which the driving wave has slopes, and only a small current flows at other times. The average current consumption depends on the driving wave and drive frequency conditions, and is usually 1/10th or less of the instantaneous current.

Under common ejection drive conditions in an inkjet printer with a piezoelectric element system where the capacity of one piezoelectric element is C=1 nF, the applied voltage V of the driving wave is 0V to 40V, and the applied period t of the driving wave is t=4 μs (i.e., a through rate of 10V/μs), the drive current I flowing through the piezoelectric element is:

$$I=C\times V/t=1(\mathrm{nF})\times 40(V)/4(\mu s)=10(\mathrm{mA}).$$

It is hence clear that the drive current I increases as the through rate of the driving wave increases (as the slope of the waveform increases).

When the time of the slope is substantially constant, such as when driving is being turned on and off, it is clear that the drive current increases at higher voltages.

The drive current is not as great if only one piezoelectric element is driven, but with a line head system in which multiple piezoelectric elements are aligned in an array pattern, an extremely large drive current must be supplied in order to simultaneously drive an extremely large number of piezoelectric elements.

If piezoelectric elements (nozzles) of M=1000 pieces are simultaneously driven to perform ejection under the above-described conditions, the drive current I in total is:

$$I=(C\times V/t)\times 1000=(1(\mathrm{nF})\times 40(V)/4(\mu s))\times 1000=10(A);$$

that is, the drive current of 10 amperes flows in an instant of 4 μs as a result.

As described with reference to FIG. 9, by distributing the load in the circuits using the plurality of driving wave generating circuits 130A to 130D, the drive current flowing through each of the driving wave generating circuits 130A to 130D can be reduced; however, the drive capacity of the power source must be large in accordance with the instantaneous current consumption. Increasing the size of the power source may result in situations in which costs increase and the printer system is impracticable.

Moreover, even if an extremely large power source can be prepared, not only does the output voltage of the power source itself instantaneously decrease due to the instantaneous current consumption, but there are also voltage drops due to impedance in patterns, flexible printed circuit (FPC) boards or other such wiring, and electrical components such as transistors and resistors in the power source line (power supply line) from the power source to the piezoelectric elements. Hence, the voltages of the driving waves applied to the piezoelectric elements ultimately decrease, and it is possible that the ink cannot be properly ejected.

Therefore, the present embodiment provides a function for controlling the phases of the plurality of common driving waves created by the plurality of driving wave generating circuits 130A to 130D. More specifically, the digital waveform data inputted to the D/A converters (the waveform generating circuits 152A to 152D) for creating waveforms can be easily staggered using clocks. In other words, the phases between the waves can be varied by suitably adjusting the timings of the clocks CLK1 to CLK4.

In a routine aimed at determining the on/off state of the nozzles and the volume of the ink to be ejected from the image data for printing, the necessary phase difference is applied by estimating the load in the circuits and the like, and adjusting the amount of stagger from the clocks according to the conditions, which operation will be described later in detail. For example, if the instantaneous current consumption is estimated to be exceeding the drive capacity of the circuits and/or the power source capacity, the amount by which the phases are staggered is increased to reduce the instantaneous current consumption, or, if the instantaneous current consumption is sufficiently lower than the drive capacity of the circuits and the power source capacity, then the amount by which the phases are staggered is reduced so as to increase the speed of printing.

Of course, the method for staggering the phases of the plurality of common driving waves is not limited to the above-described method, and waves with different phases may be created by varying the digital waveform data using a common clock.

Figures 11A, 11B, 11C:
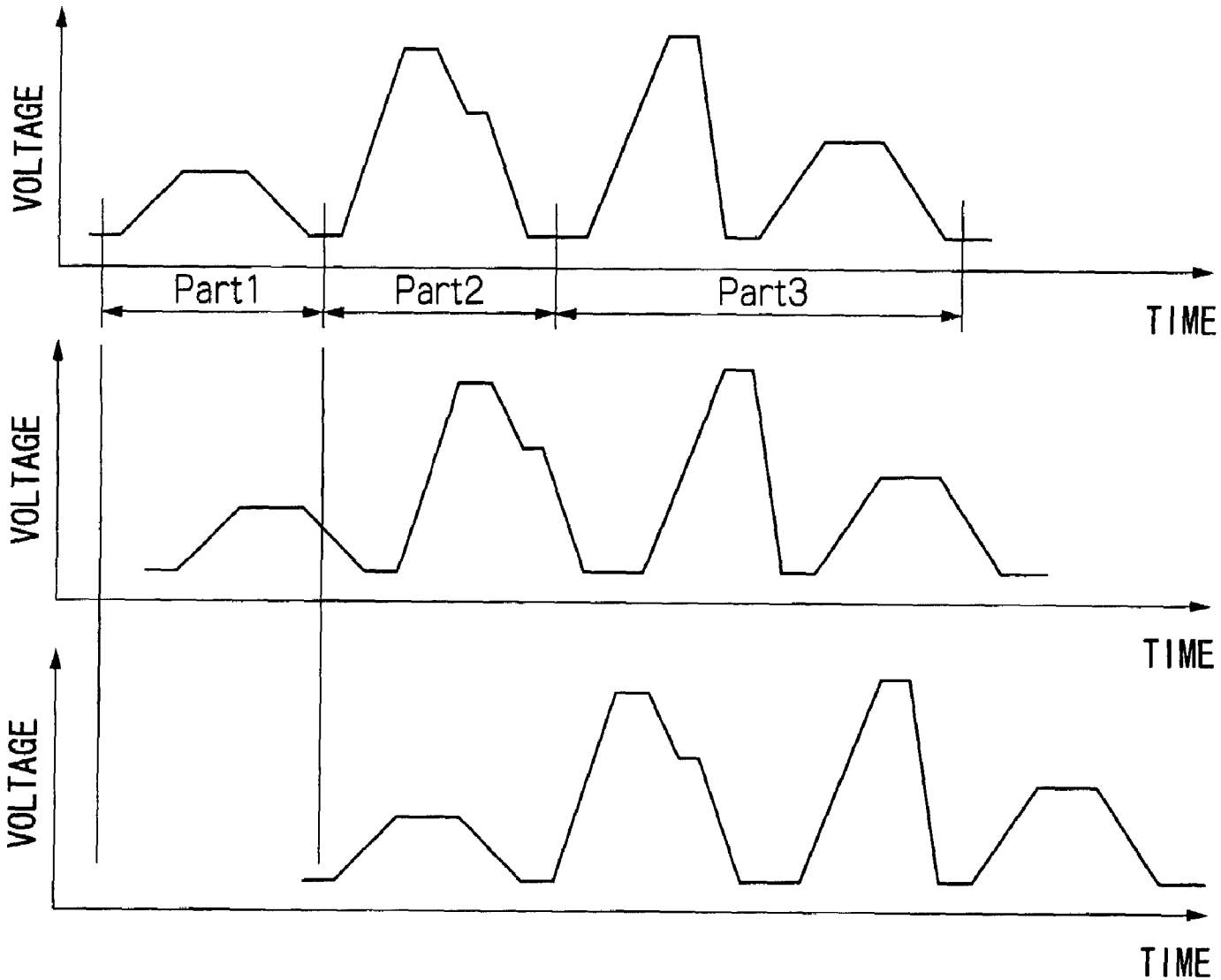
FIGS. 11A to 11C are waveform diagrams showing examples of staggering the phases among a plurality of common driving waves.

FIGS. 11A to 11C show an example of how the phases are staggered among the plurality of common driving waves. FIG. 11A shows a common driving wave as a reference (referred to as "reference wave"). FIGS. 11B and 11C show first and second waveform examples, respectively, of which phases have been staggered in relation to the reference wave in FIG. 11A.

In the example in FIG. 11B, the phase of the staggered common driving wave is adjusted so that the sloped sections (rising and falling) have minimal overlapping with those of the reference wave. If the sloped sections do inevitably overlap, it is preferable to select sections for overlapping with a gentle slope as much as possible. The instantaneous current consumption is thereby distributed over time, and the maximum instantaneous current consumption is effectively suppressed in terms of the power source.

The phases may be adjusted in advance as shown in FIGS. 11A and 11B for the common driving waves outputted from the plurality of driving wave generating circuits 130A to 130D, or the phases may be appropriately adjusted in accordance with the image data.

More specifically, since the nozzles that are to eject ink and the volume of the ink to be ejected by each nozzle are determined by processing the image data, the driving waves applied to the piezoelectric elements needed for ejection are also known. Furthermore, since the amount of the electric current needed is also calculated from the driving waves, the phases may be appropriately adjusted according to such calculation results. For example, since a driving wave for ejecting a large volume of ink consumes a large amount of electric current, when large volumes of ink are simultaneously ejected, it is effective in terms of the drive circuits and the power source to perform ejection by using a plurality of common driving waves while staggering phases thereof.

FIG. 11C is an example of staggering the phase in units of waveform elements in relation to the reference wave in FIG. 11A.

As shown in FIGS. 11A to 11C, the amount by which the phases of the plurality of common driving waves are staggered is preferably minimized in order to increase the speed of printing.

Figures 12A, 12B, 12C, 12D, 12E:
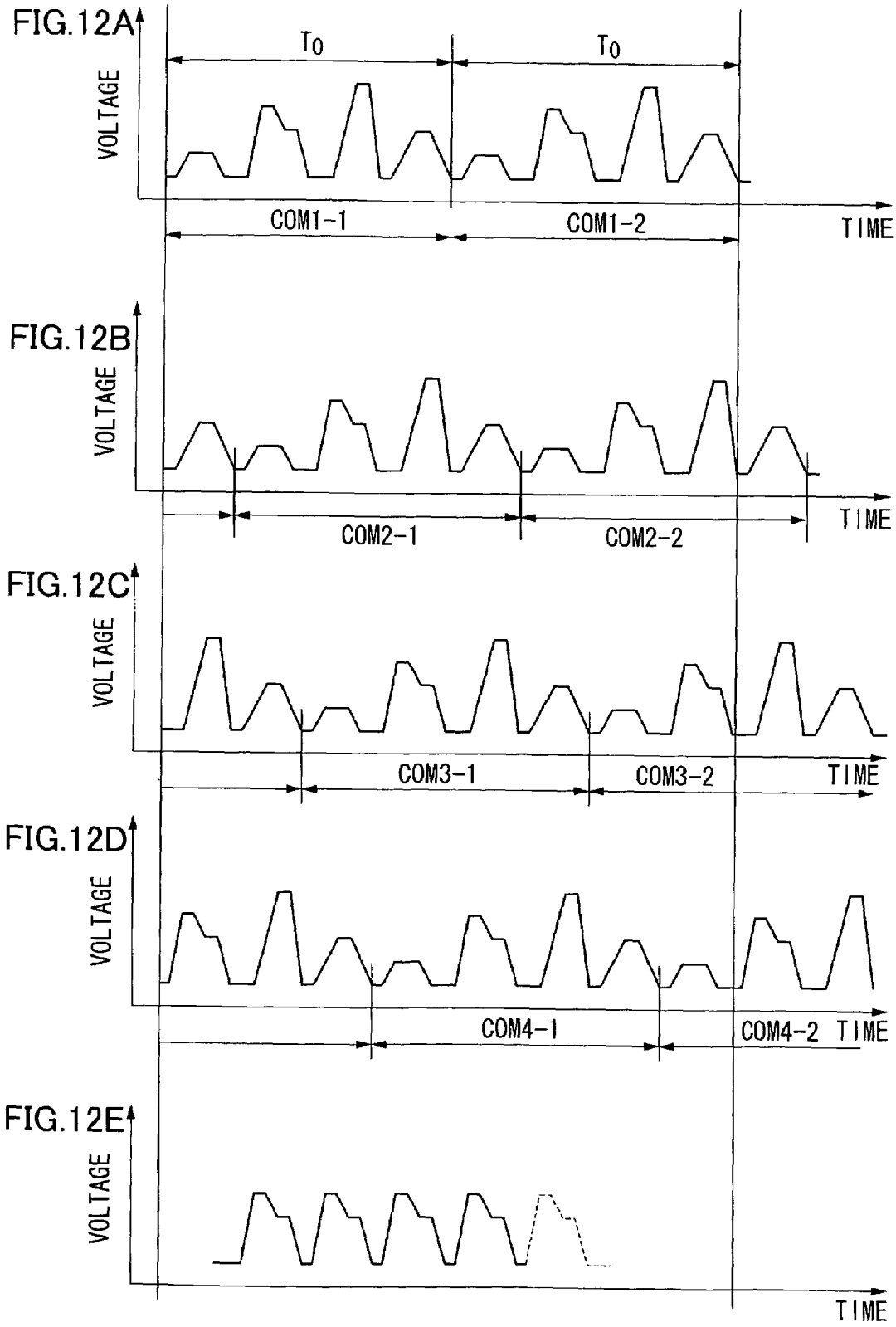
FIGS. 12A to 12E are waveform diagrams showing examples of a plurality of common driving waves and examples of a drive signal applied to an actuator.

For example, when regarding the earliest common driving wave in FIG. 12A as the reference common driving wave, the drive cycles of the other common driving waves are preferably fit within two cycles of the driving wave cycle $T_0$ of the reference common driving wave, as shown in FIGS. 12B to 12D. In other words, the phases of the staggered common driving waves are preferably adjusted so that the waveforms in a single cycle the staggered common driving waves completely fits within two cycles ($2\times T_0$) of the reference common driving wave.

In the examples in FIGS. 12B to 12D, the phase staggers are $T_0/4$ in FIG. 12B, $T_0/2$ in FIG. 12C, and $(3/4)\cdot T_0$ in FIG. 12D, respectively, in relation to the reference common driving wave in FIG. 12A.

According to this embodiment, in which a plurality of common driving waves with such a phase relationship are used, a plurality of driving waves with different phases can be used within two cycles of a reference driving wave, and therefore ink ejection can be performed multiple times in a single driving wave cycle $T_0$, and high-speed printing is possible. FIG. 12E shows an example in which a maximum of four ejections for small dots are made possible within a single driving wave cycle $T_0$ by selectively extracting waveform elements for small dot ejection from the common driving waves in FIGS. 12A to 12D.

Furthermore, using a plurality of driving waves with different phases to shorten the ejection cycle not only increases the printing speed, but also achieves the effects of image processing by depositing a plurality of dots overlapped on substantially the same position on the recording medium. Such an example is described with reference to FIGS. 13A to 13C.

Figure 13C:
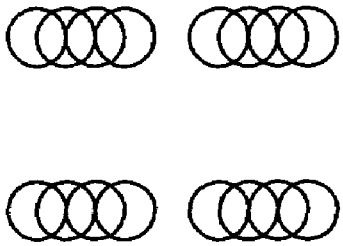
FIGS. 13A to 13C are diagrams used to describe a graphic representation of image processing effects resulting from deposition control.
Figure 13B:
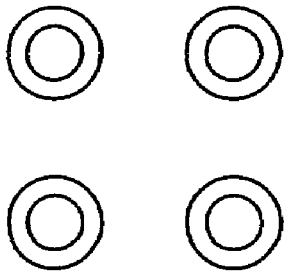
Figure 13A:
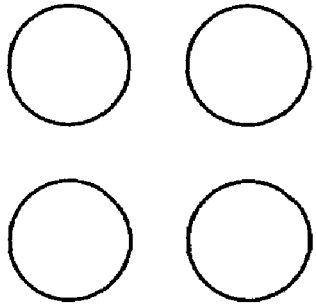

FIG. 13A is an example in which large dots are formed by normal deposition methods. FIG. 13B is an example in which the volume in one ejection is reduced and the deposition number of times is controlled (in this example, two depositions). FIG. 13C is an example in which the deposition positions are controlled (in this example, in the sub-scanning direction).

The effects of image processing are made more prominent using a procedure in which grayscaling based on the deposition times at which a plurality of small-volume ink depositions are performed as in FIG. 13B, rather than a single large-volume ink deposition is performed as in FIG. 13A, is made to match the grayscaling from the driving wave. From the standpoint of the deposition positions, the deposition positions of extremely small dots can be controlled using the phase difference within one pixel as in FIG. 13C, and stronger image processing effects are achieved when the recording medium is conveyed simultaneously with ejection (or when the head is moved over the recording medium).

As has already been stated, since the plurality of drive circuits have nonuniformities between circuits, if the same nozzle groups or the same actuators are constantly driven by the same drive circuits, then patterning occurs depending on the image data, and the patterning tends to be observed as unevenness in the resulted image. Moreover, sometimes the effects of nonuniformities in the characteristics of the actuators cannot be ignored in a head that is provided with an extremely large number of actuators.

In the present embodiment, the actuators 58 are driven by appropriately switching the plurality of drive circuits 130A to 130D in a single image, in view of the fact that one actuator 58 can be driven by any of the drive circuits 130A to 130D as described with reference to FIG. 9. The drive circuits may be switched regularly according to specific selection rules established in advance, or a drive circuit may be selected at random from among the plurality of drive circuits. As a result, patterning is avoided, and the effects of nonuniformities in the actuators 58 are reduced and are not likely to be observed as unevenness in the resulted image.

In a head with multiple nozzles that are densely arranged in two dimensions, a plurality of actuators 58 corresponding to the nozzles are arranged at high density, the electrical wiring of the actuators 58 is also formed and installed at high density, and therefore there is concern for problems with electrical crosstalk when these densely arranged multiple actuators 58 are simultaneously driven.

In view of this, in the present embodiment, for example, common driving waves (for example, standard electric potential, slope and other shape characteristics of the common driving wave, drive cycle) with different phases are selected for adjacent nozzles or for adjacent wires. Using a plurality of common driving wave signals with different phases makes it possible to control crosstalk of electrical signals, and to transmit the appropriate drive signals to the actuators 58.

Furthermore, when the plurality of densely aligned actuators are simultaneously driven, problems often occur with ink crosstalk or ink refilling that are related to the head structure (the internal flow channel structure). In view of this, in the present embodiment, crosstalk can be suppressed and sufficient time can be allowed for ink filling because of a configuration in which the phases of the plurality of common driving waves can be staggered so as to adjust the ejection intervals.

Next, the print control in the inkjet recording apparatus 10 will be described in detail.

Figure 14:
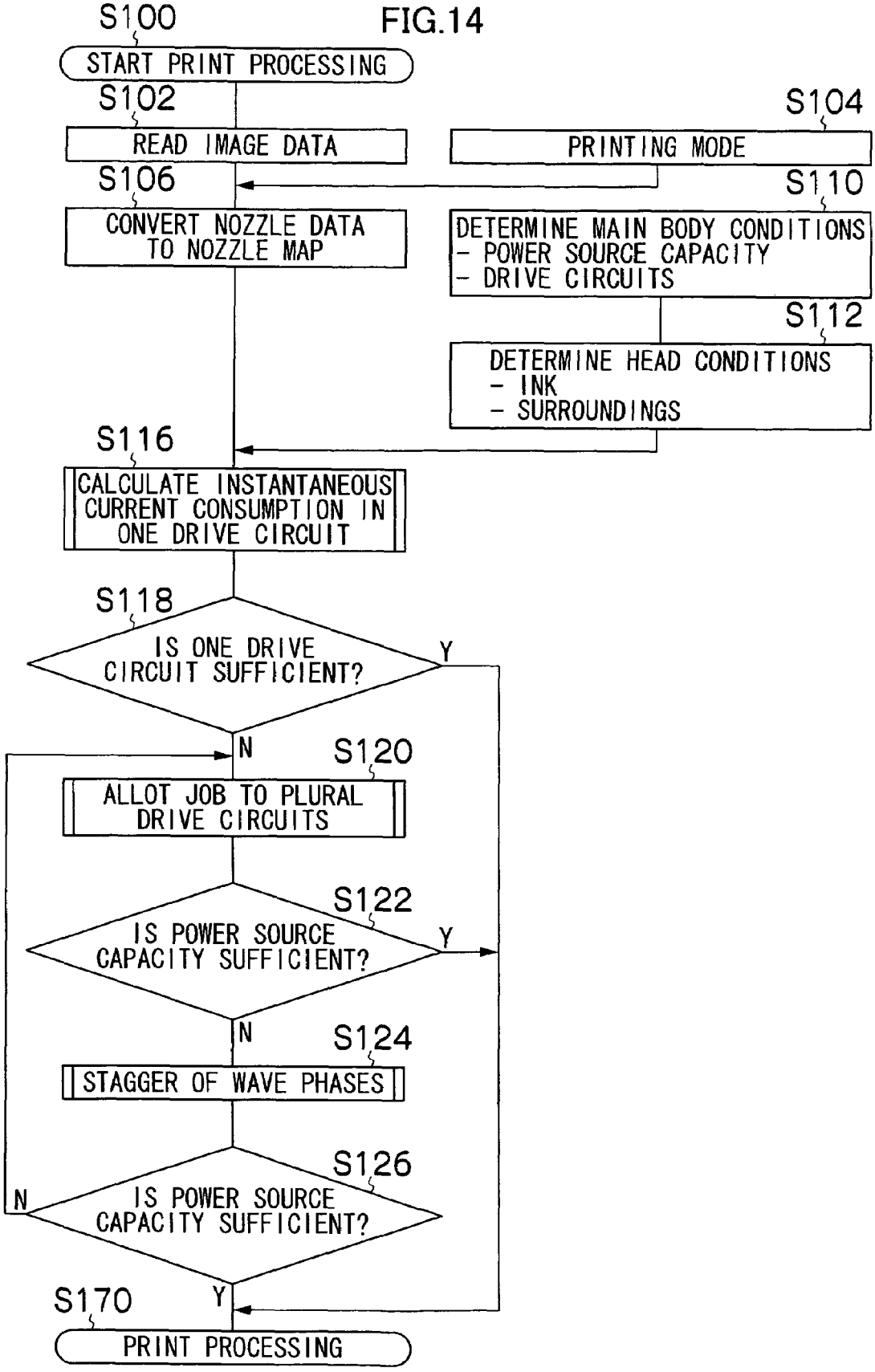
FIG. 14 is a flowchart showing a first embodiment of a print control in the inkjet recording apparatus.

FIG. 14 is a flowchart showing a first embodiment of the print control. When the print processing begins (step S100), image data for printing is read (step S102), and information for the printing mode (for example, normal paper printing, high image quality printing, high speed printing, and the like) is acquired (step S104). A nozzle map is then created to determine which nozzles have a voltage applied to the actuators thereof to eject ink on the basis of the image data and the printing mode (step S106).

Then, the conditions of the main body of the inkjet recording apparatus 10 are determined (or the information thereof is acquired), so that information pertaining to the power source capacity, the number of drive circuits (four in the example in FIG. 9), and the like is obtained (step S110). The head conditions are determined (step S112), so that information pertaining to the state and type of the head, the ink conditions (for example, type and amount remaining), and the surroundings is obtained. The information of the main body of the inkjet recording apparatus 10 is stored in an EEPROM or another such storage device, and the information is read out as necessary. The common driving waves (for example, standard electric potential, slope and other shape characteristics of the common driving wave, drive cycle) are selected in accordance with the information thus acquired.

Thereafter, the instantaneous current consumption is calculated from the ejection waveforms and the on/off state of the nozzles when driving is performed with one drive circuit, according to the various information described above and the nozzle map (step S116). The results of this calculation are compared with a specific allowable value that has been set according to the drive capability of one drive circuit, and it is determined whether the load can be driven by one drive circuit (step S118). If the instantaneous current consumption is estimated to be below the drive capability of one drive circuit (when the determination is YES is step S118), then a drive circuit is selected from among the plurality of driving wave generating circuits 130A to 130D, and is used for ejection driving (step S170).

On the other hand, if it is determined in step S118 that the instantaneous current consumption will exceed the drive capability of one drive circuit (when the determination is NO in step S118), the plurality of drive circuits (two or more) to be used are selected from among the plurality of drive circuits (four in the example in FIG. 9) installed in the inkjet recording apparatus 10 (step S120). In order to evenly distribute the load in the selected plurality of drive circuits, the connection relationship between the actuators 58 and the selected drive circuits is determined, the total instantaneous current consumption is calculated, and the calculated results are compared with a specific upper limit that has been set in accordance with the power source capacity (step S122).

If the result of the determination in step S122 is that the instantaneous current consumption of the drive circuits to be used in total is estimated to be below the capacity of the power source (when the determination is YES in step S122), then ejection is performed (step S170). On the other hand, if it is determined in step S122 that the instantaneous current consumption of the drive circuits to be used in total exceeds the capacity of the power source, at least one of the plurality of common driving waves is staggered in phase (step S124). When the shapes or phases of the driving waves or other such conditions change, the current consumption also change, and therefore the instantaneous current consumption is recalculated in accordance with the changed conditions, and the results of this calculation are compared with the power source capacity (i.e., the specific upper limit) (step S126). The arithmetic formulas and coefficients necessary for calculating the instantaneous electric currents accompanying the changes in conditions are stored in the storage device (for example, EEPROM or the like) in the inkjet recording apparatus 10.

If the determination is NO in step S126, the process returns to step S120, then the selection of drive circuits, allotment of the load, and control of the phases are renewed, so that the phases are readjusted. The process progresses through steps S120 to S126 so as to determine the phase conditions for the instantaneous current consumption within the power source capacity, and ejection driving is then performed (step S170) if the determination is YES in either step S122 or step S126.

The overload on the drive circuits 130A to 130D can be reduced and ejection defects resulting from waveform distortion can be suppressed by performing control according to the flowchart in FIG. 14. Moreover, the size of the drive circuits can be reduced because the estimations of the drive capability in terms of circuit design can be reduced. Furthermore, staggering the phases of the plurality of common driving waves makes it possible not only to suppress the instantaneous current consumption, but also to increase the printing speed.

FIG. 15 is a flowchart showing a second embodiment of the print control. The steps in FIG. 15 that are common to the flowchart in FIG. 14 are denoted with the same step numbers, and descriptions thereof are omitted. In the flowchart in FIG. 15, steps S118 through S126 in FIG. 14 are replaced by steps S130 through S134.

More specifically, a plurality of drive circuits are selected (step S130) and the phases of a plurality of driving waves are staggered (step S132) in accordance with the results of the instantaneous current consumption calculated in step S116 and the conditions of the image processing effects (ejection volume, ejection intervals, ejection times, deposition positions). Then, the instantaneous current consumption of the drive circuits is analyzed under these conditions, the instantaneous current consumption of the entire system is estimated, and the results of this calculation are compared with the power source capacity (i.e., the specific upper limit) (step S134).

If the result of the determination in step S134 is that the instantaneous current consumption of the drive circuits to be used in total is estimated to be below the capacity of the power source (when the determination is YES in step S134), then ejection is performed (step S170). On the other hand, if it is determined in step S134 that the instantaneous current consumption of the drive circuits to be used in total exceeds the capacity of the power source, then the process returns to step S130, the conditions of the image processing effects are reset, and the selection of drive circuits and control of the phases are readjusted. The process progresses through steps S130 to S134 so as to determine the selection of drive circuits and the phase conditions for the instantaneous current consumption within the power source capacity, and ejection driving is then performed (step S170) if the determination is YES in step S134.

It is possible to achieve the image processing effects by performing control according to the flowchart in FIG. 15 as described with reference to FIGS. 13A to 13C.

Figure 16:
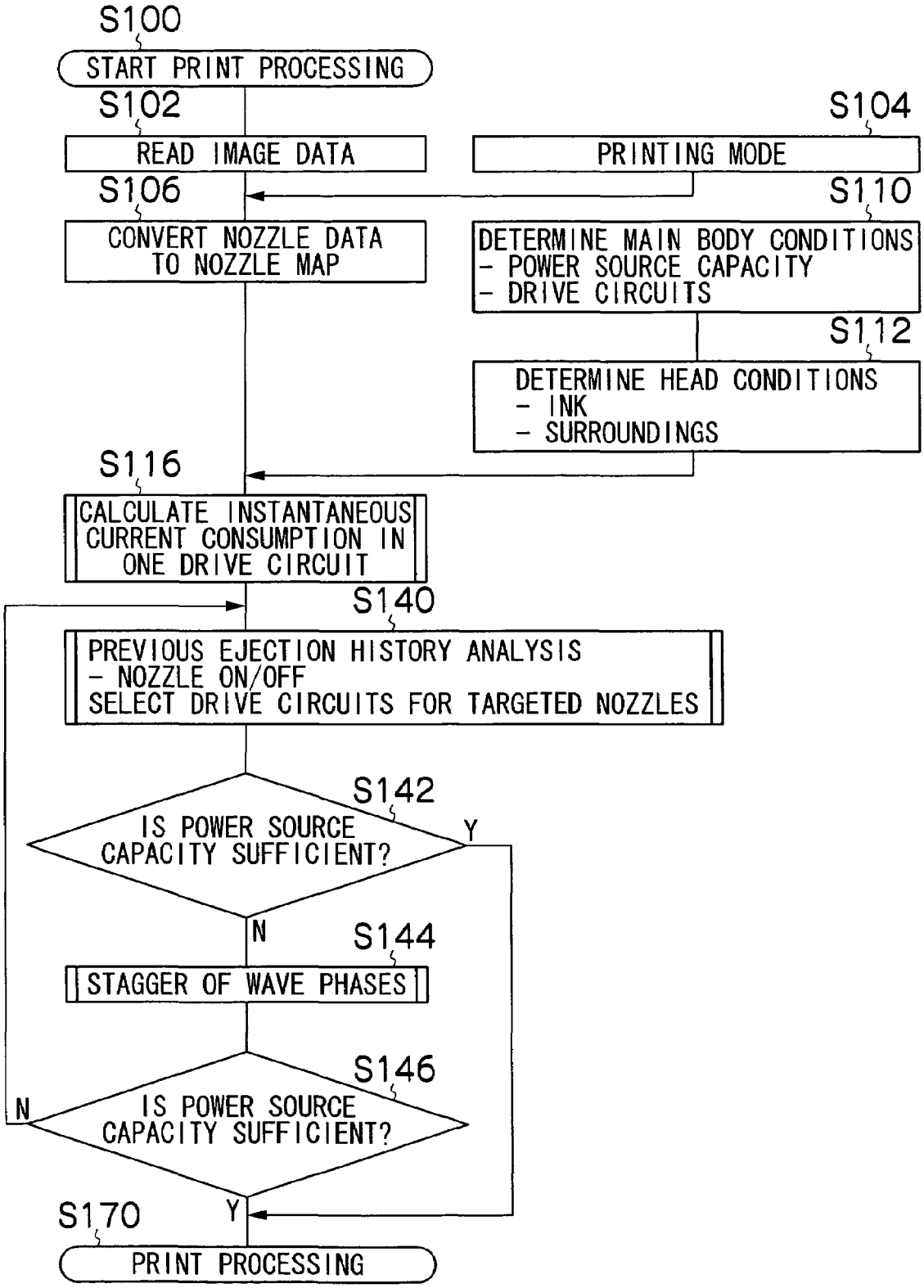
FIG. 16 is a flowchart showing a third embodiment of a print control in the inkjet recording apparatus.

FIG. 16 is a flowchart showing a third embodiment of the print control. The steps in FIG. 16 that are common to the flowchart in FIG. 14 are denoted with the same step numbers, and descriptions thereof are omitted. In the flowchart in FIG. 16, steps S118 through S126 in FIG. 14 are replaced by steps S140 through S146.

More specifically, one of the plurality of drive circuits to apply the common driving wave to one of the nozzles is selected from the plurality of drive circuits according to the results of the instantaneous current consumption calculated in step S116 and the previous nozzle map history (step S140). For example, the drive circuit different from the drive circuit used in the previous ejection is selected.

Next, the calculated instantaneous current consumption is compared with the specific upper limit that has been set in accordance with the power source capacity (step S142), and if the instantaneous current consumption of the drive circuits to be used in total is estimated to be below the capacity of the power source (when the determination is YES in step S142), then ejection is performed (step S170). On the other hand, if it is determined in step S142 that the instantaneous current consumption of the drive circuits to be used in total exceeds the capacity of the power source, then at least one group of phases in the plurality of common driving waves is staggered (step S144). The instantaneous current consumption is recalculated along with this phase control, and the results of this calculation are compared with the power source capacity (i.e., the specific upper limit) (step S146). If the determination is NO in step S146, the process returns to step S140, and the selection of the drive circuits and control of the phases are readjusted. The process progresses through steps S140 to S146 so as to determine the phase conditions and the selection of drive circuits for the instantaneous current consumption within the power source capacity, and ejection driving is performed (step S170) if the determination is YES in either step S142 or step S146.

It is possible to reduce unevenness resulting from nonuniformities between drive circuits and nonuniformities between actuators by performing control according to the flowchart in FIG. 16.

Figure 17:
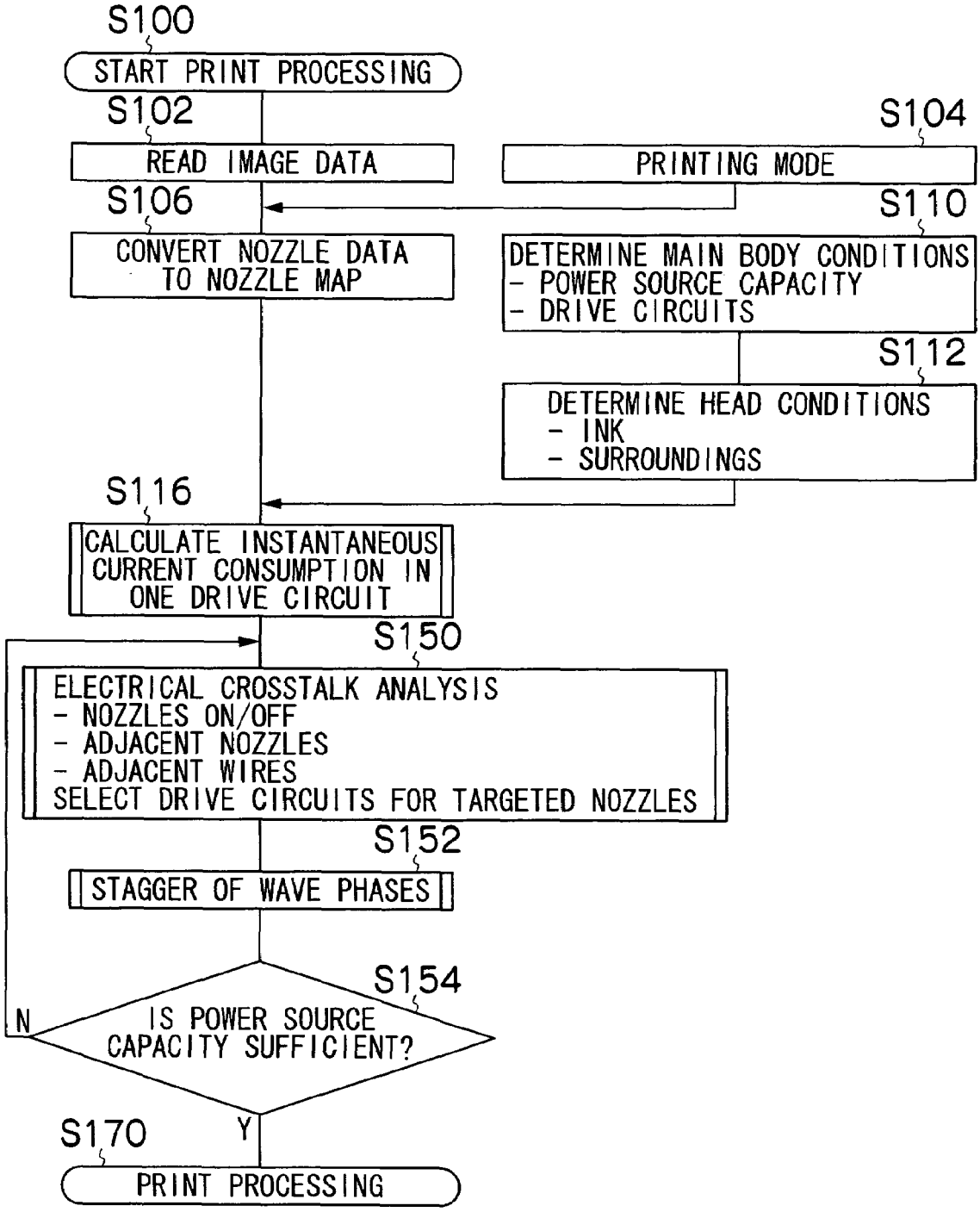
FIG. 17 is a flowchart showing a fourth embodiment of a print control in the inkjet recording apparatus.

FIG. 17 is a flowchart showing a fourth embodiment of the print control. The steps in FIG. 17 that are common to the flowchart in FIG. 14 are denoted with the same step numbers, and descriptions thereof are omitted. In the flowchart in FIG. 17, steps S118 through S126 in FIG. 14 are replaced by steps S150 through S154.

More specifically, two of the plurality of drive circuits are selected according to the results of the instantaneous current consumption calculated in step S116 so as to apply the different driving waves to two of the nozzles that are adjacent to each other and/or have the wires adjacent to each other (step S150), so that the driving waves of which phases are staggered from each other are applied to the adjacent nozzles (step S152). Then, the instantaneous current consumption of the drive circuits is analyzed under these conditions, the total instantaneous current consumption (of the entire system) is estimated, and the results of this calculation are compared with the power source capacity (i.e., the specific upper limit) (step S154).

If the result of the determination in step S154 is that the instantaneous current consumption of the drive circuits to be used in total is estimated to be below the capacity of the power source (when the determination is YES in step S154), then ejection is performed (step S170). On the other hand, if it is determined in step S154 that the instantaneous current consumption of the drive circuits to be used in total exceeds the capacity of the power source, then the process returns to step S150, and the phases of the plurality of driving waves are further staggered. The process progresses through steps S150 to S152 so as to determine the phase conditions and the selection of drive circuits for the instantaneous current consumption within the power source capacity, and ejection driving is then performed (step S170) if the determination is YES in step S154.

It is possible to reduce unevenness resulting from electrical crosstalk by performing control according to the flowchart in FIG. 17.

Figure 18:
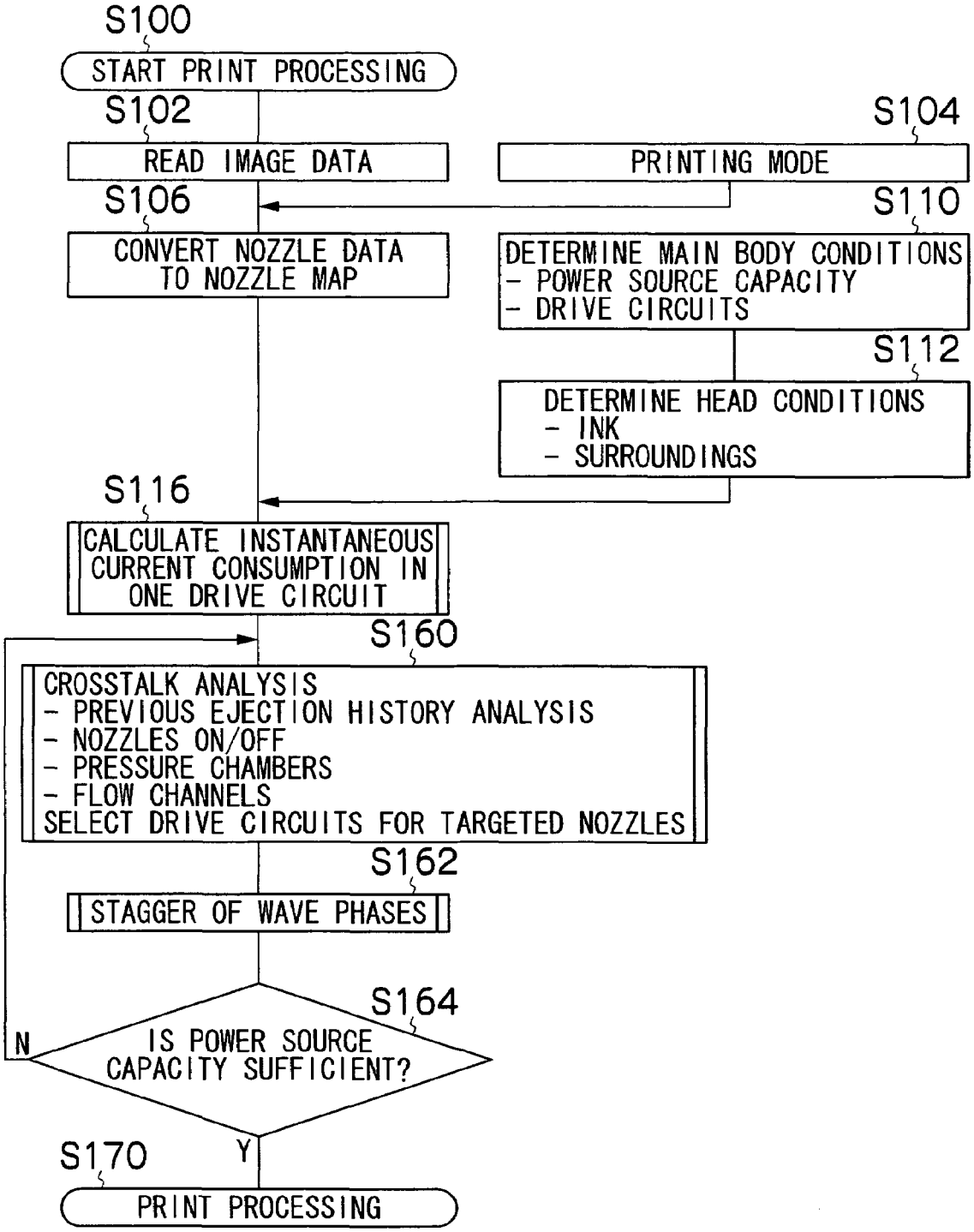
FIG. 18 is a flowchart showing a fifth embodiment of a print control in the inkjet recording apparatus.

FIG. 18 is a flowchart showing a fifth embodiment of the print control. The steps in FIG. 18 that are common to the flowchart in FIG. 14 are denoted with the same step numbers, and descriptions thereof are omitted. In the flowchart in FIG. 18, steps S118 through S126 in FIG. 14 are replaced by steps S160 through S164.

More specifically, two of the plurality of drive circuits are selected from the plurality of drive circuits according to the results of the instantaneous current consumption calculated in step S116 so as to apply the different driving waves to two of the nozzles that are adjacent to each other, have the pressure chambers adjacent to each other, and/or have the flow channels adjacent to each other, or have the same flow channel in common (step S160), so that the driving waves of which phases are staggered from each other are applied to the two nozzles (step S162).

For example, when the nozzles are densely mounted, and when ink is ejected in large volumes, time is needed for the piezoelectric elements to stabilize, for the meniscus to reach a stable state, and for the ink to be refilled, and therefore the phases of the driving waves are adjusted so that the ejection timings are staggered for adjacent nozzles or nozzles with the same flow channel.

Then, the instantaneous current consumption of the drive circuits is analyzed under these conditions, the total instantaneous current consumption (of the entire system) is estimated, and the results of this calculation are compared with the power source capacity (i.e., the specific upper limit) (step S164).

If the result of the determination in step S164 is that the instantaneous current consumption of the drive circuits to be used in total is estimated to be below the capacity of the power source (when the determination is YES in step S164), then ejection is performed (step S170). On the other hand, if it is determined in step S164 that the instantaneous current consumption of the drive circuits to be used in total exceeds the capacity of the power source, then the process returns to step S160, and the phases of the plurality of driving waves are further staggered. The process progresses through steps S160 to S162 so as to determine the phase conditions and the selection of drive circuits for the instantaneous current consumption within the power source capacity, and ejection driving is then performed (step S170) if the determination is YES in step S164.

It is possible to reduce unevenness resulting from liquid crosstalk in the ink by performing control according to the flowchart in FIG. 18.

Although FIGS. 14 through 18 are described as individual flowcharts, these control embodiments can be suitably combined. The control sequences or the aspects of combining two or more of these control embodiments are not particularly limited.

The analyses, determinations, and calculations in the flowcharts described in FIGS. 14 through 18 may be performed with a CPU or image processing LSI installed in the inkjet recording apparatus 10, or they may be performed by the host computer 86 or by distributing the processing between the CPU and the LSI in the inkjet recording apparatus 10 and the host computer 86.

Although the embodiments have been described in which four drive circuits (driving wave generating circuits 130A to 130D) are provided, the number of drive circuits is not limited to the above-described embodiments, and it is enough that at least two drive circuits are used when implementing the present invention.

If the number of divided drive circuits is increased, not only does the drive current for one drive circuit decrease and the range of selection for the transistor used for the power amplifier increase, but transistors capable of high-speed switching, which is an important characteristic for waveform generation, can also be used. A suitable number of drive circuits is designed by taking into account the number of actuators, the ejection properties, the circuit size, the cost, and other factors.

Other Embodiments

Figure 19:
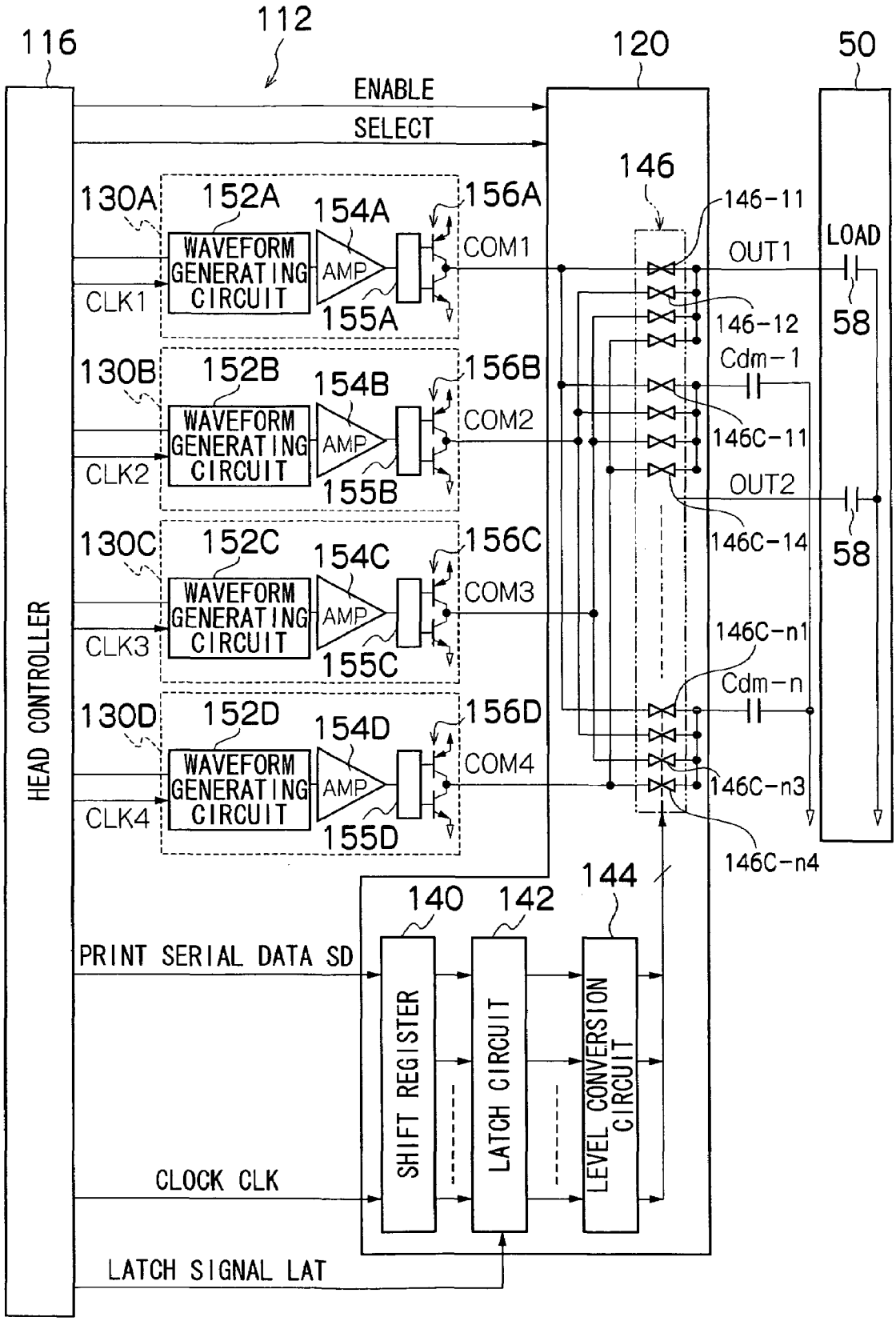
FIG. 19 is a principal circuit structural diagram showing another embodiment of the present invention.

Another device for controlling the waveform distortion resulting from load fluctuation and for preventing loss in image quality will now be described. FIG. 19 is a principal structural view showing another embodiment of the present invention. Components in FIG. 19 that are identical to or resembling those in FIG. 9 are denoted with the same reference numerals, and descriptions thereof are omitted.

In the configuration in FIG. 19, ceramic condensers Cdm-i (i=1, 2, . . . , n) are provided as dummy loads (dummy elements) separate from the actuator 58 provided in the head 50 for the ejection driving, and the ceramic condensers Cdm-i (i=1, 2, . . . , n) are connected to the driving wave generating circuits 130A to 130D through switch elements 146C-ij (j=1, 2, 3, 4).

According to the configuration shown in FIG. 19, the waveform distortion between the drive circuits can be suppressed by selectively using the ceramic condensers Cdm-i so that the loads are constantly uniform in the plurality of driving wave generating circuits 130A to 130D.

Moreover, appropriately selecting the drive circuits on the basis of the image data as described in FIGS. 10A to 10E allows for a smaller number of the ceramic condensers to be prepared than in the conventional method of simply dividing the circuits. For example, when ejection is performed simultaneously from an extremely large number of nozzles, the drive circuits are divided as much as possible to distribute the load, and slightly remaining nonuniformities in the load between circuits are made uniform by using the ceramic condensers Cdm-i. When ejection of small amounts is performed, some of the drive circuits are halted, the load is distributed among the rest of the drive circuits, and the slight load nonuniformities are made uniform by using the ceramic condensers.

The plurality of ceramic condensers Cdm-i may have the same electrostatic capacitance with the actuators 58 of the head 50, or a combination of condensers with different electrostatic capacitances may be used. More specifically, the number of ceramic condensers Cdm-i (i=1, 2, . . . , n) and the electrostatic capacitances thereof are not particularly limited, and the same number of condensers with the same electrostatic capacitances as the actuators 58 of the head 50 do not necessarily need to be prepared, but it is also possible to use a configuration with fewer condensers than the actuators 58.

Moreover, the actuators 58 for the ejection driving and the ceramic condensers Cdm-i (i=1, 2, . . . , n) may be combined and connected to a single switch IC 120, or a switch IC used exclusively for connecting the piezoelectric elements for the ejection driving and another switch IC used exclusively for connecting the dummy load ceramic condensers may be provided separately.

Although the inkjet recording apparatus for color printing that uses inks of multiple colors has been described, the present invention can also be applied to an inkjet recording apparatus for single color (monochrome) printing.

Moreover, although the inkjet recording apparatus is given as an example of an image forming apparatus in the above descriptions, the applicable range of the present invention is not limited thereto. For example, the drive apparatus for a liquid ejection head of the present invention or a liquid ejection apparatus of the present invention can be applied to a photographic image forming apparatus or the like in which developing liquid is applied without contact with the printing paper. Furthermore, the applicable range of the drive apparatus for a liquid ejection head of the present invention or a liquid ejection apparatus of the present invention is not limited to an image forming apparatus, and the present invention can also be applied to various apparatuses (coating apparatuses, painting apparatuses, wire drawing apparatuses, and the like) that use a liquid ejection head to spray processing liquid or other various liquids onto an ejection receiving medium.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a liquid ejection head which includes a plurality of nozzles and a plurality of pressure generating elements provided correspondingly to the plurality of nozzles, the pressure generating elements being applied with drive signals to eject recording liquid from the corresponding nozzles;

a plurality of driving wave generating circuits which generate drive-signal waves for driving the pressure generating elements;

a circuit selecting device which switches connection relationships between the pressure generating elements and the driving wave generating circuits so as to selectively apply the drive-signal waves from at least two of the driving wave generating circuits to each of the pressure generating elements;

a power source which supplies electricity to the pressure generating elements through the driving wave generating circuits;

a connection control device which, in accordance with image data representing an image to be formed, selects at least one of the driving wave generating circuits used to drive the pressure generating elements, and controls connection between the at least one of the driving wave generating circuits and the pressure generating elements, so that instantaneous current consumption of each of the driving wave generating circuits falls within a specific allowable value; and a phase control device which controls phases of the drive-signal waves generated by the driving wave generating circuits so that the instantaneous current consumption at the power source falls within a specific upper limit.

2. The image forming apparatus as defined in claim 1, further comprising:

a calculation device which calculates the instantaneous current consumption of the power source according to the image data and compares the calculated instantaneous current consumption of the power source with the specific upper limit, wherein the phase control device changes an amount of a shift of the phases of the drive-signal waves generated by the driving wave generating circuits which the connection control device selects so that the instantaneous current consumption of the power source is equal to or less than the specific upper limit in a case where the connection control device selects at least two of the driving wave generating circuits and the instantaneous current consumption of the power source exceeds the specific upper limit according to the comparing by the calculation device, and adopts conditions of the phases of the drive-signal waves generated by the driving wave generating circuits which the connection control device selects as conditions used when the instantaneous current consumption of the power source is calculated in a case where the instantaneous current consumption of the power source is equal to or less than the specific upper limit according to the comparing by the calculation device.

3. An image forming apparatus, comprising:

a liquid ejection head which includes a plurality of nozzles and a plurality of pressure generating elements provided correspondingly to the plurality of nozzles, the pressure generating elements being applied with drive signals to eject recording liquid from the corresponding nozzles;

a plurality of driving wave generating circuits which generate drive-signal waves for driving the pressure generating elements;

a phase control device which controls phases of the drive-signal waves generated by the driving wave generating circuits;

a circuit selecting device which switches connection relationships between the pressure generating elements and the driving wave generating circuits so as to selectively apply the drive-signal waves from at least two of the driving wave generating circuits to each of the pressure generating elements; and a connection control device which, in accordance with results of image processing for image data representing an image to be formed, selects at least two of the driving wave generating circuits used to drive the pressure generating elements, and controls connection between the driving wave generating circuits and the pressure generating elements, so that the drive-signal waves are applied from the at least two of the driving wave generating circuits to the pressure elements at timings different from each other, in order to perform ejection of the recording liquid to achieve image formation reflecting the results of image processing.

4. The image forming apparatus as defined in claim 3, comprising:

a power source which supplies electricity to the pressure generating elements through the driving wave generating circuits; and a calculation device which calculates the instantaneous current consumption of the power source according to the image data and compares the calculated instantaneous current consumption of the power source with the specific upper limit, wherein the phase control device changes an amount of a shift of the phases of the drive-signal waves generated by the driving wave generating circuits which the connection control device selects so that the instantaneous current consumption of the power source is equal to or less than the specific upper limit in a case where the instantaneous current consumption of the power source exceeds the specific upper limit according to the comparing by the calculation device, and adopts conditions of the phases of the drive-signal waves generated by the driving wave generating circuits which the connection control device selects as conditions used when the instantaneous current consumption of the power source is calculated in a case where the instantaneous current consumption of the power source is equal to or less than the specific upper limit according to the comparing by the calculation device.

5. An image forming apparatus, comprising:

a liquid ejection head which includes a plurality of nozzles and a plurality of pressure generating elements provided correspondingly to the plurality of nozzles, the pressure generating elements being applied with drive signals to eject recording liquid from the corresponding nozzles;

a plurality of driving wave generating circuits which generate drive-signal waves for driving the pressure generating elements;

a circuit selecting device which switches connection relationships between the pressure generating elements and the driving wave generating circuits so as to selectively apply the drive-signal waves from at least two of the driving wave generating circuits to each of the pressure generating elements; and a selection control device which, in accordance with image data representing an image to be formed and with drive histories of the pressure generating elements, selects the driving wave generating circuits used to drive the pressure generating elements, and controls connection between the selected driving wave generating circuits and the pressure generating elements.

6. The image forming apparatus as defined in claim 5, further comprising:

a storage device which stores information of the drive histories including information indicating whether the pressure generating elements are being driven and selection information indicating which of the driving wave generating circuits are used for driving, wherein the selection control device, in accordance with the image data representing an image to be formed and the information of the drive histories of the pressure generating elements stored in the storage device, selects the driving wave generating circuits used to drive the pressure generating elements and controls connection between the selected driving wave generating circuits and the pressure generating elements, in such a manner that the driving wave generating circuits that are different from the driving wave generating circuits used previously are selected.

7. The image forming apparatus as defined in claim 5, wherein the drive history is information indicating whether the pressure generating elements are being driven or information indicating which of the driving wave generating circuits are used for driving.

8. An image forming apparatus, comprising:

a liquid ejection head which includes a plurality of nozzles and a plurality of pressure generating elements provided correspondingly to the plurality of nozzles, the pressure generating elements being applied with drive signals to eject recording liquid from the corresponding nozzles;

a plurality of driving wave generating circuits which generate drive-signal waves for driving the pressure generating elements;

a phase control device which controls phases of the drive-signal waves generated by the driving wave generating circuits;

a circuit selecting device which switches connection relationships between the pressure generating elements and the driving wave generating circuits so as to selectively apply the drive-signal waves from at least two of the driving wave generating circuits to each of the pressure generating elements; and a connection control device which, in accordance with image data representing an image to be formed, determines positions of the nozzles to be driven, selects the driving wave generating circuits used to drive the pressure generating elements, and controls connection between the selected driving wave generating circuits and the pressure generating elements, so that the pressure generating elements respectively corresponding to the nozzles adjacent to each other are applied with the drive-signal waves of phases different from each other from the driving wave generating circuits different from each other.

9. An image forming apparatus, comprising:

a liquid ejection head which includes a plurality of nozzles and a plurality of pressure generating elements provided correspondingly to the plurality of nozzles, the pressure generating elements being applied with drive signals to eject recording liquid from the corresponding nozzles;

a plurality of driving wave generating circuits which generate drive-signal waves for driving the pressure generating elements;

a phase control device which controls phases of the drive-signal waves generated by the driving wave generating circuits;

a circuit selecting device which switches connection relationships between the pressure generating elements and the driving wave generating circuits so as to selectively apply the drive-signal waves from at least two of the driving wave generating circuits to each of the pressure generating elements; and a connection control device which, in accordance with image data representing an image to be formed, determines positions of the nozzles to be driven, selects the driving wave generating circuits used to drive the pressure generating elements, and controls connection between the selected driving wave generating circuits and the pressure generating elements, so that the pressure generating elements having wires adjacent to each other are applied with the drive-signal waves of phases different from each other from the driving wave generating circuits different from each other.

10. An image forming apparatus, comprising:

a liquid ejection head which includes a plurality of nozzles and a plurality of pressure generating elements provided correspondingly to the plurality of nozzles, the pressure generating elements being applied with drive signals to eject recording liquid from the corresponding nozzles;

a plurality of driving wave generating circuits which generate drive-signal waves for driving the pressure generating elements;

a phase control device which controls phases of the drive-signal waves generated by the driving wave generating circuits;

a circuit selecting device which switches connection relationships between the pressure generating elements and the driving wave generating circuits so as to selectively apply the drive-signal waves from at least two of the driving wave generating circuits to each of the pressure generating elements; and a connection control device which, in accordance with image data representing an image to be formed, determines positions of the nozzles to be driven, selects the driving wave generating circuits used to drive the pressure generating elements, and controls connection between the selected driving wave generating circuits and the pressure generating elements, so that the pressure generating elements respectively corresponding to the nozzles adjacent to each other and having a liquid channel in common are applied with the drive-signal waves of phases different from each other from the driving wave generating circuits different from each other.

11. A drive control method for a liquid ejection head which includes a plurality of nozzles and a plurality of pressure generating elements provided correspondingly to the plurality of nozzles, the method comprising the steps of:

providing a plurality of driving wave generating circuits which generate drive-signal waves for driving the pressure generating elements to eject recording liquid from the corresponding nozzles;

providing a configuration which allows switching of connection relationships between the pressure generating elements and the driving wave generating circuits so as to selectively apply the drive-signal waves from at least two of the driving wave generating circuits to each of the pressure generating elements;

in accordance with image data representing an image to be formed, determining a number and positions of the nozzles to be driven, estimating loads on the driving wave generating circuits, and selecting at least one of the driving wave generating circuits used to drive the pressure generating elements, so that instantaneous current consumption of each of the driving wave generating circuits falls within a specific allowable value;

controlling connection between the at least one of the driving wave generating circuits and the pressure generating elements; and controlling phases of the drive-signal waves generated by the driving wave generating circuits so that the instantaneous current consumption at a power source falls within a specific upper limit, the power source supplying electricity to the pressure generating elements through the driving wave generating circuits.

12. The drive control method as defined in claim 11, further comprising the steps of:

calculating instantaneous current consumption of the power source which supplies the electricity to the pressure generating elements through the driving wave generating circuits, and comparing the calculated instantaneous current consumption of the power source with the specific upper limit; and changing an amount of a shift of the phases of the drive-signal waves generated by the driving wave generating circuits which the connection control device selects so that the instantaneous current consumption of the power source is equal to or less than the specific upper limit in a case where the connection control device selects at least two of the driving wave generating circuits and the instantaneous current consumption of the power source exceeds the specific upper limit according to the comparing by the calculation device, and adopting conditions of the phases of the drive-signal waves generated by the driving wave generating circuits which the connection control device selects as conditions used when the instantaneous current consumption of the power source is calculated in a case where the instantaneous current consumption of the power source is equal to or less than the specific upper limit according to the comparing by the calculation device.

13. A drive control method for a liquid ejection head which includes a plurality of nozzles and a plurality of pressure generating elements provided correspondingly to the plurality of nozzles, the method comprising the steps of:

providing a plurality of driving wave generating circuits which generate drive-signal waves for driving the pressure generating elements to eject recording liquid from the corresponding nozzles;

providing a configuration which allows controlling of phases of the drive-signal waves generated by the driving wave generating circuits;

providing a configuration which allows switching of connection relationships between the pressure generating elements and the driving wave generating circuits so as to selectively apply the drive-signal waves from at least two of the driving wave generating circuits to each of the pressure generating elements; and in accordance with results of image processing for image data representing an image to be formed, selecting at least two of the driving wave generating circuits used to drive the pressure generating elements, and controlling connection between the driving wave generating circuits and the pressure generating elements, so that the drive-signal waves are applied from the at least two of the driving wave generating circuits to the pressure elements at timings different from each other, in order to perform ejection of the recording liquid to achieve image formation reflecting the results of image processing.

14. The drive control method as defined in claim 13, further comprising the steps of:

calculating instantaneous current consumption of the power source which supplies the electricity to the pressure generating elements through the driving wave generating circuits, and comparing the calculated instantaneous current consumption of the power source with the specific upper limit; and changing an amount of a shift of the phases of the drive-signal waves generated by the driving wave generating circuits which the connection control device selects so that the instantaneous current consumption of the power source is equal to or less than the specific upper limit in a case where the instantaneous current consumption of the power source exceeds the specific upper limit according to the comparing by the calculation device, and adopting conditions of the phases of the drive-signal waves generated by the driving wave generating circuits which the connection control device selects as conditions used when the instantaneous current consumption of the power source is calculated in a case where the instantaneous current consumption of the power source is equal to or less than the specific upper limit according to the comparing by the calculation device.

15. A drive control method for a liquid ejection head which includes a plurality of nozzles and a plurality of pressure generating elements provided correspondingly to the plurality of nozzles, the method comprising the steps of:

providing a plurality of driving wave generating circuits which generate drive-signal waves for driving the pressure generating elements to eject recording liquid from the corresponding nozzles;

providing a configuration which allows switching of connection relationships between the pressure generating elements and the driving wave generating circuits so as to selectively apply the drive-signal waves from at least two of the driving wave generating circuits to each of the pressure generating elements; and in accordance with image data representing an image to be formed and with drive histories of the pressure generating elements, selecting the driving wave generating circuits used to drive the pressure generating elements, and controlling connection between the selected driving wave generating circuits and the pressure generating elements, in order to level frequencies of use of the driving wave generating circuits.

16. The drive control method as defined in claim 15, further comprising the steps of:

storing information of the drive histories including information indicating whether the pressure generating elements are being driven and selection information indicating which of the driving wave generating circuits are used for driving; and selecting the driving wave generating circuits used to drive the pressure generating elements and controlling connection between the selected driving wave generating circuits and the pressure generating elements in accordance with image data representing an image to be formed and with the information of the drive histories of the pressure generating elements stored in the storage device, in such a manner that the driving wave generating circuits that is different from the driving wave generating circuits used previously is selected.

17. A drive control method for a liquid ejection head which includes a plurality of nozzles and a plurality of pressure generating elements provided correspondingly to the plurality of nozzles, the method comprising the steps of:

providing a plurality of driving wave generating circuits which generate drive-signal waves for driving the pressure generating elements to eject recording liquid from the corresponding nozzles;

providing a configuration which allows controlling of phases of the drive-signal waves generated by the driving wave generating circuits;

providing a configuration which allows switching of connection relationships between the pressure generating elements and the driving wave generating circuits so as to selectively apply the drive-signal waves from at least two of the driving wave generating circuits to each of the pressure generating elements; and in accordance with image data representing an image to be formed, determining positions of the nozzles to be driven, selecting the driving wave generating circuits used to drive the pressure generating elements, and controlling connection between the selected driving wave generating circuits and the pressure generating elements, so that the pressure generating elements respectively corresponding to the nozzles adjacent to each other are applied with the drive-signal waves of phases different from each other from the driving wave generating circuits different from each other.

18. A drive control method for a liquid ejection head which includes a plurality of nozzles and a plurality of pressure generating elements provided correspondingly to the plurality of nozzles, the method comprising the steps of:

providing a plurality of driving wave generating circuits which generate drive-signal waves for driving the pressure generating elements to eject recording liquid from the corresponding nozzles;

providing a configuration which allows controlling of phases of the drive-signal waves generated by the driving wave generating circuits;

providing a configuration which allows switching of connection relationships between the pressure generating elements and the driving wave generating circuits so as to selectively apply the drive-signal waves from at least two of the driving wave generating circuits to each of the pressure generating elements; and in accordance with image data representing an image to be formed, determining positions of the nozzles to be driven, selecting the driving wave generating circuits used to drive the pressure generating elements, and controlling connection between the selected driving wave generating circuits and the pressure generating elements, so that the pressure generating elements having wires adjacent to each other are applied with the drive-signal waves of phases different from each other from the driving wave generating circuits different from each other.

19. A drive control method for a liquid ejection head which includes a plurality of nozzles and a plurality of pressure generating elements provided correspondingly to the plurality of nozzles, the method comprising the steps of:

providing a plurality of driving wave generating circuits which generate drive-signal waves for driving the pressure generating elements to eject recording liquid from the corresponding nozzles;

providing a configuration which allows controlling of phases of the drive-signal waves generated by the driving wave generating circuits;

providing a configuration which allows switching of connection relationships between the pressure generating elements and the driving wave generating circuits so as to selectively apply the drive-signal waves from at least two of the driving wave generating circuits to each of the pressure generating elements; and in accordance with image data representing an image to be formed, determining positions of the nozzles to be driven, selecting the driving wave generating circuits used to drive the pressure generating elements, and controlling connection between the selected driving wave generating circuits and the pressure generating elements, so that the pressure generating elements respectively corresponding to the, nozzles adjacent to each other and having a liquid channel in common are applied with the drive-signal waves of phases different from each other from the driving wave generating circuits different from each other.

* * * * *